US010978802B2

(12) United States Patent
Abe et al.

(10) Patent No.: US 10,978,802 B2
(45) Date of Patent: Apr. 13, 2021

(54) WIRELESS COMMUNICATION DEVICE AND ELECTRONIC APPARATUS

(71) Applicant: CANON KABUSHIKI KAISHA, Tokyo (JP)

(72) Inventors: Daiki Abe, Nishitokyo (JP); Makoto Aoki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 265 days.

(21) Appl. No.: 15/545,862

(22) PCT Filed: Feb. 12, 2016

(86) PCT No.: PCT/JP2016/054769
§ 371 (c)(1),
(2) Date: Jul. 24, 2017

(87) PCT Pub. No.: WO2016/133178
PCT Pub. Date: Aug. 25, 2016

(65) Prior Publication Data

US 2018/0006378 A1 Jan. 4, 2018

(30) Foreign Application Priority Data

Feb. 18, 2015 (JP) ..... 2015-029369
Feb. 18, 2015 (JP) ..... 2015-029371
Feb. 18, 2015 (JP) ..... JP2015-029370

(51) Int. Cl.
*H01Q 1/24* (2006.01)
*H01Q 9/04* (2006.01)
(Continued)

(52) U.S. Cl.
CPC ..... *H01Q 9/0457* (2013.01); *H01Q 1/24* (2013.01); *H01Q 1/48* (2013.01); *H01Q 9/42* (2013.01)

(58) Field of Classification Search
CPC ..... H01G 9/0457; H01G 1/24; H01G 1/48; H01G 9/42
See application file for complete search history.

(56) References Cited

U.S. PATENT DOCUMENTS 6,945,713 B2 9/2005 Vraa et al.
9,568,367 B2 2/2017 Nemirovsky
(Continued)

FOREIGN PATENT DOCUMENTS

EP 1 189 106 A2 3/2002
JP 2010-104650 A 5/2010
(Continued)

OTHER PUBLICATIONS

Hirasawa Kazuhiro, "Antenna Characteristics and Basic Technique for Solution", Nikkan Kogyo Shimbun, Ltd. (Feb. 17, 2011) pp. 113-139.
(Continued)

*Primary Examiner* — Dameon E Levi
*Assistant Examiner* — David E Lotter
(74) *Attorney, Agent, or Firm* — Venable LLP

(57) ABSTRACT

A wireless communication device includes: an antenna including an antenna element, and a ground conductor; an IC connected to the antenna; and a metal member arranged to face the antenna. The ground conductor includes one end and the other end in the X direction. The metal member includes a metal plate, and a projection protruding from the metal plate toward the antenna. The projection is arranged at a position of overlapping with the end of the ground conductor as viewed in the −Z direction. Such a configuration improves the transmission and reception gains at the communication frequency of a radio element.

20 Claims, 29 Drawing Sheets

(51) Int. Cl.
*H01Q 1/48* (2006.01)
*H01Q 9/42* (2006.01)

(56) References Cited

U.S. PATENT DOCUMENTS

| | | | | |
|---|---|---|---|---|
| 2009/0026376 | A1 | 1/2009 | Kuwabara et al. | |
| 2010/0258730 | A1* | 10/2010 | Sumi | G01T 1/2018 250/361 R |
| 2012/0228499 | A1 | 9/2012 | Koyanagi | |
| 2013/0076574 | A1* | 3/2013 | Rappoport | H01Q 1/243 343/702 |
| 2013/0121468 | A1 | 5/2013 | Ohta et al. | |
| 2016/0241288 | A1 | 8/2016 | Aoki et al. | |
| 2017/0214119 | A1 | 7/2017 | Aoki | |

FOREIGN PATENT DOCUMENTS

| | | | |
|---|---|---|---|
| JP | 2012-103268 | A | 5/2012 |
| WO | 2011/151756 | A2 | 12/2011 |

OTHER PUBLICATIONS

International Search Report and Written Opinion of the International Searching Authority dated Oct. 5, 2016 in PCT/JP2016/054769.

PCT International Preliminary Report on Patentability and PCT International Search Report and Written Opinion of the International Searching Authority in PCT/JP2016/054769 (dated Aug. 22, 2017).

* cited by examiner

WIRELESS COMMUNICATION DEVICE AND ELECTRONIC APPARATUS

TECHNICAL FIELD

The present invention relates to a wireless communication device that includes a metal member arranged to face an antenna, and an electronic apparatus that includes the wireless communication device.

BACKGROUND ART

Many electronic apparatuses in recent years, such as imaging apparatuses (smartphones, etc.) and personal computers (PCs), have been equipped with wireless communication devices that communicate through a wireless LAN or Bluetooth®. Digital cameras and X-ray image diagnostic apparatuses in recent years equipped with the aforementioned wireless communication devices to transmit taken images to another camera or PC have been widespread.

Radio waves in a 2.4 [GHz] band or 5 [GHz] band are used for wireless communication via wireless LAN or Bluetooth®. An antenna for wireless communication is attached to an electronic apparatus equipped with a wireless communication device. Various antennas are used, the types of which include, for example, monopole antennas, dipole antennas, inverted-F antennas, patch antennas, and chip antennas.

These antennas are required to be embedded in a limited space to reduce the size of electronic apparatuses and improve aesthetic designs. Furthermore, the cost is required to be reduced. To reduce the size and cost, the antenna is often arranged in a casing of a product. However, if the antenna is accommodated in a small electronic apparatus, the antenna and an adjacent metal member are required to be arranged close to each other. This arrangement causes a problem of varying resonant characteristics of the antenna.

Conventionally, as one of measures for preventing such a problem, a method has been known that increases power supplied to a radio element made of, e.g., a semiconductor package to compensate the amount of degradation in radiant power and increase the radiant quantity of radio waves in a communication frequency (NPL 1).

CITATION LIST

Non Patent Literature

NPL 1: Kazuhiro Hirasawa "Antenna Characteristics and Basic Technique for Solution" Nikkan Kogyo Shimbun, Ltd. (Feb. 17, 2011, pp. 113-139)

SUMMARY OF INVENTION

Technical Problem

However, increase in supply power, in turn, increases the power consumption of a wireless communication device. Consequently, there is a problem in that, for example, adoption of a battery reduces the time during which the power can be supplied, and the amount of data that can communicate by one time charging. Increase in supply power increases the amount of heat generation particularly in a radio element. In an electronic apparatus that has a difficulty to create a way for heat dissipation, measures for dissipating heat is separately required. Consequently, the requirement causes a problem of increasing the cost.

The present invention thus has an object to improve transmission and reception gains in communication frequencies of a radio element.

Solution to Problem

One aspect of the present invention provides a wireless communication device including: an antenna that includes an antenna element whose one end is open, and a ground conductor to which another end of the antenna element is connected and which is used as a ground; a metal member arranged to face the antenna; and a radio element connected to the antenna, wherein the ground conductor includes a first end located on a side of the open one end of the antenna element, and a second end located on a side opposite to the open one end of the antenna element, and wherein the metal member includes a metal main body, and a projection that projects from the metal main body toward the antenna, in at least one region between a first region facing the first end of the metal member and a second region facing the second end.

Another aspect of the present invention provides a wireless communication device including: an antenna that includes an antenna element whose one end is open, and a ground conductor to which another end of the antenna element is connected and which is used as a ground; a metal member arranged to face the antenna; and a radio element connected to the antenna, wherein on a surface of the metal member, at a position overlapping with at least a part of a region facing a region having a ratio of an electric field intensity to a magnetic field intensity of the antenna 1.0 or more times and 1.8 or less times as high as a minimum value, a concave is formed in a direction away from the antenna.

Further another aspect of the present invention provides a wireless communication device including: an antenna that includes an antenna element whose one end is open, and a ground conductor to which another end of the antenna element is connected and which is used as a ground; a metal member arranged to face the antenna; a radio element connected to the antenna; and a conductor piece that is provided so as to cover a region including a site on the ground conductor at which a ratio of an electric field intensity to a magnetic field intensity is a maximum and which has a surface area larger than an area of the region.

Further features of the present invention will become apparent from the following description of exemplary embodiments with reference to the attached drawings.

DESCRIPTION OF EMBODIMENTS

First Embodiment

Figure 1:
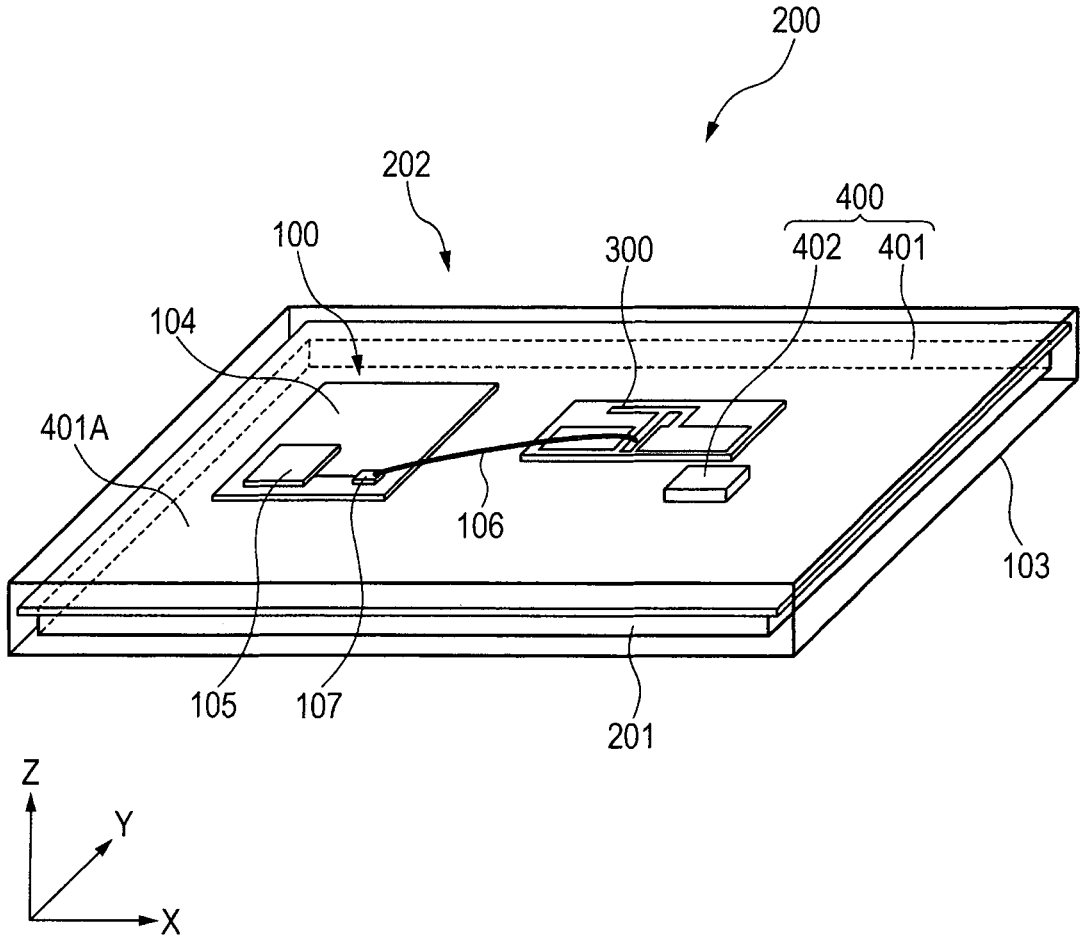
FIG. 1 is a diagram illustrating an X-ray image diagnostic apparatus, which is an example of an electronic apparatus including a wireless communication device according to a first embodiment of the present invention.

Hereinafter, a first embodiment of the present invention is described in detail with reference to the drawings. FIG. 1 is a diagram illustrating an X-ray image diagnostic apparatus, which is an example of an electronic apparatus including a wireless communication device according to the first embodiment of the present invention. Here, the X, Y and Z directions illustrated in FIG. 1 are directions orthogonal to (intersecting with) each other.

An X-ray image diagnostic apparatus 200 illustrated in FIG. 1 includes an X-ray imaging element (imaging element) 201, and a wireless communication device 202. An image signal taken and generated by the imaging element 201 is output to the wireless communication device 202. The wireless communication device 202 having received the image signal transmits signal waves modulated to have a frequency in a communication frequency band to another electronic apparatus, such as another camera or PC, not illustrated, through wireless communication, such as of a wireless LAN and Bluetooth®. Radio waves in a 2.4 [GHz] band (e.g., 2.45 [GHz]) or 5 [GHz] band are used for wireless communication via a wireless LAN or Bluetooth®.

The wireless communication device 202 includes a casing 103 also serving as a casing of the X-ray image diagnostic apparatus 200 and made of a nonconductive material, such as a resin, a printed circuit board 100, a cable 106, an antenna 300, and a metal member 400, which are arranged in the casing 103. The metal member 400 is an element for blocking electromagnetic waves. "Blocking electromagnetic waves" means absorption or reflection of electromagnetic waves. In this embodiment, the description is made for the case where the metal material of the metal member 400 is, e.g., stainless steel. Alternatively, any metal material that blocks electromagnetic waves may be adopted. For example, the metal material may be any of iron, copper, and aluminum. In this embodiment, the metal member 400 also serves as reinforcement of the casing 103. On the metal member 400, the printed circuit board 100 and the antenna 300 are mounted. The antenna 300 and the metal member 400 are close to each other.

The printed circuit board 100 includes a printed wiring board 104. The printed circuit board 100 includes an IC (Integrated Circuit) 105 that serves as a radio element, and a connector 107 connected to the IC 105 by wiring of the printed wiring board 104, which are mounted on the printed wiring board 104. The antenna 300 is connected to one end of the cable 106. The other end of the cable 106 is connected to the connector 107. Thus, the IC 105 is connected to the antenna 300 via the cable 106. The IC 105 is a radio element for wirelessly transmitting and receiving signal waves via the antenna 300. That is, the IC 105 internally contains a transmitter and a receiver. In this embodiment, the description is made for the case where the IC 105, which serves as the radio element, includes the transmitter and the receiver, and can transmit and receive signal waves. Alternatively, a case where the radio element only functions as a transmitter, or a case where the radio element only functions as a receiver may be adopted. The case where the transmitter and the receiver are integrated in one IC 105 (semiconductor package) is described. Alternatively, the transmitter and the receiver may be separately made up of respective semiconductor packages.

The IC 105 processes the received image signal, and wirelessly transmits signal waves modulated to have a frequency in the communication frequency band (e.g., 2.4 [GHz] band or 5 [GHz] band) through the antenna 300.

The antenna 300 may be any one that can efficiently emit electromagnetic waves at a communication frequency. In this embodiment, the antenna is an inverted-F antenna.

Figure 2:
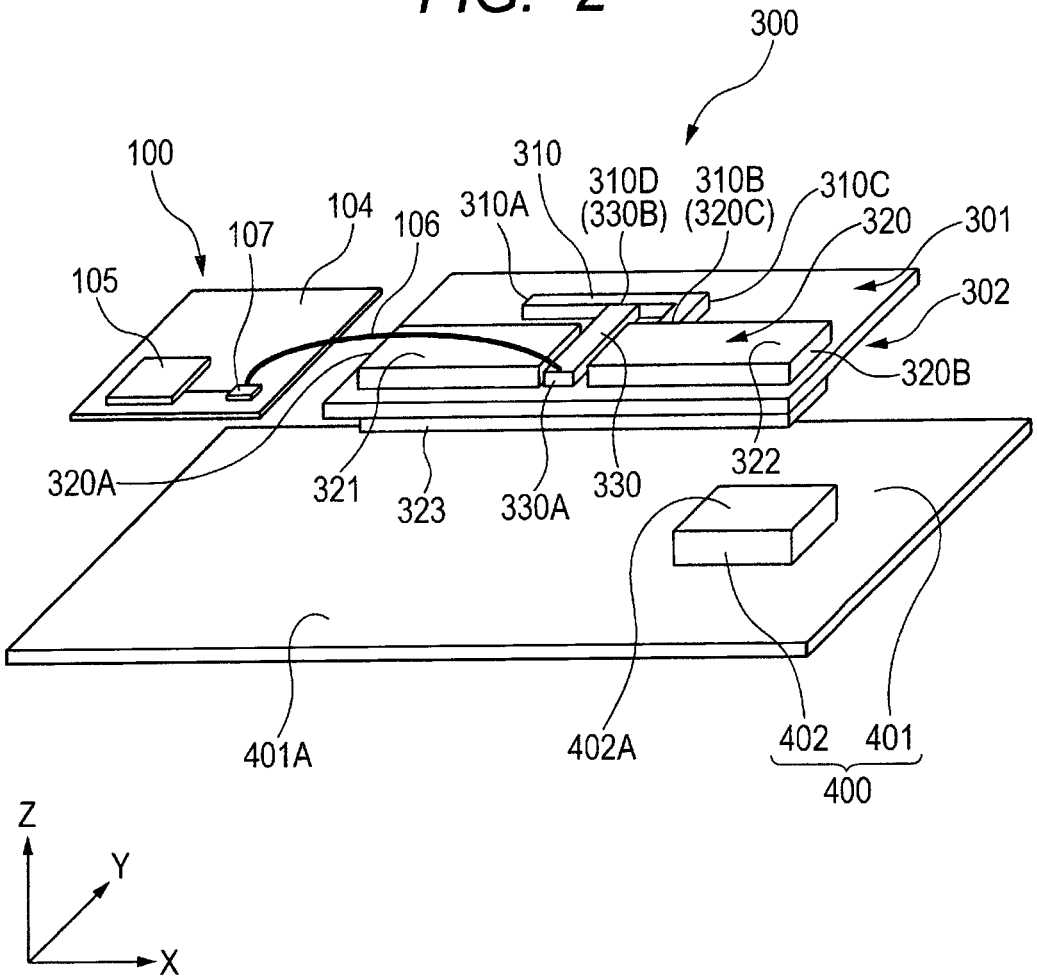
FIG. 2 is an exploded perspective view for illustrating the arrangement relationship between a printed circuit board, an antenna, and a metal member of the wireless communication device according to the first embodiment of the present invention.

FIG. 2 is an exploded perspective view for illustrating the arrangement relationship between the printed circuit board, the antenna, and the metal member of the wireless communication device according to this embodiment.

As illustrated in FIGS. 1 and 2, the metal member 400 is arranged to face the antenna 300. More specifically, in FIG. 1, the antenna 300 is arranged between the inner surface of the casing 103 and one surface of the metal member 400 in the Z direction. A member that is made of a dielectric substance (insulator) and is not illustrated may intervene between the antenna 300 and the metal member 400.

As illustrated in FIG. 1, the imaging element 201 is arranged on a side opposite to a side where the antenna 300 is arranged in the Z direction with respect to the metal member 400. More specifically, in FIG. 1, the imaging element 201 is arranged between the other surface of the metal member 400 and the inner surface of the casing 103 in the Z direction.

As illustrated in FIGS. 1 and 2, the metal member 400 includes a metal plate 401 that serves as a metal main body and has a surface 401A on the side facing the antenna 300. The metal member 400 includes a projection 402 that is formed on the surface 401A of the metal plate 401 and protrudes from the surface 401A of the metal plate 401 in the +Z direction on the side of the antenna 300. The projection 402 is formed to have a rectangular shape as viewed in the −Z direction.

The metal plate 401 is plate-shaped metal. The projection 402 is metal integrally formed with the metal plate 401. The metal plate 401 and the projection 402 are made of the same metal material. In this embodiment, the case is described where the metal plate 401 and the projection 402 are integrally formed. Any configuration where these elements are electrically connected to each other may be adopted. These elements may be made of separate elements, and the projection 402 may be fixed to the metal plate 401 with an unillustrated fixing member or adhesive.

The surface of the antenna 300 that faces the metal member 400 and the surface 401A of the metal plate 401 are arranged in substantially parallel to each other. The printed circuit board 100 is arranged on the side where the antenna 300 is arranged in the Z direction with respect to the metal member 400. That is, the printed circuit board 100 is arranged to face the surface 401A of the metal plate 401.

The metal plate 401 is a plate-shaped member for supporting the imaging element 201 and components of the printed circuit board 100. The case is thus described where the metal main body is the metal plate 401. Alternatively, the body may be a box-shaped member, such as an electric shielding box. In this case, one surface of the box-shaped member faces the antenna 300.

The antenna 300 is made of the printed wiring board, and includes at least two conductive layers, which are conductive layers 301 and 302 in this embodiment as illustrated in FIG. 2.

The conductive layer 301 and the conductive layer 302 are adjacent to each other via an insulation layer. The conductive layers 301 and 302 are layers on which conductors are mainly arranged. The insulation layer is a layer where an insulator (dielectric substance) is mainly arranged. The insulator of the printed wiring board that is other than the conductors constituting the antenna 300 is a glass epoxy resin, such as FR4.

The antenna 300 includes an antenna element 310, a ground conductor 320, and a signal line 330. The antenna element 310, the ground conductor 320 and the signal line 330 are made of conductors. The ground conductor 320 is used as a ground of the antenna element 310.

The antenna element 310 is formed to have a long strip-shaped conductive pattern. One end 310A of the antenna element 310 in the longitudinal direction is a free open end. Another end 310B of the antenna element 310 is short-circuited (connected) to the ground conductor 320.

The other end 310B of the antenna element 310 also serves as a connection portion 320C for connection with the ground conductor 320. The antenna element 310 may be formed to have the shape of a straight line. In this embodiment, the antenna element 310 is formed to have an L-shape such that the one end 310A of the antenna element 310 in the longitudinal direction is close to the ground conductor 320. More specifically, the antenna element 310 extends from the other end 310B to a bent portion 310C in the +Y direction, and extends from the bent portion 310C to the one end 310A in the −X direction intersecting with (orthogonal to) the Y direction.

The signal line 330 is an electric supply line through which the current of signal waves is supplied from the IC 105 through the cable 106. The signal line 330 is an electric supply line through which the current of signal waves received by the antenna element 310 is supplied.

The signal line 330 is a conductive pattern formed to extend in the Y direction. One end 330A of the signal line 330 in the longitudinal direction (Y direction) is connected to the cable 106. That is, the one end 330A of the signal line 330 is connected to the IC 105, which serves as the radio element, through the cable 106. Another end 330B of the signal line 330 in the Y direction is connected to a connection portion 310D between the one end 310A and the other end 310B of the antenna element 310. The antenna element 310 and the signal line 330 are formed on the conductive layer 301.

Figure 3A:
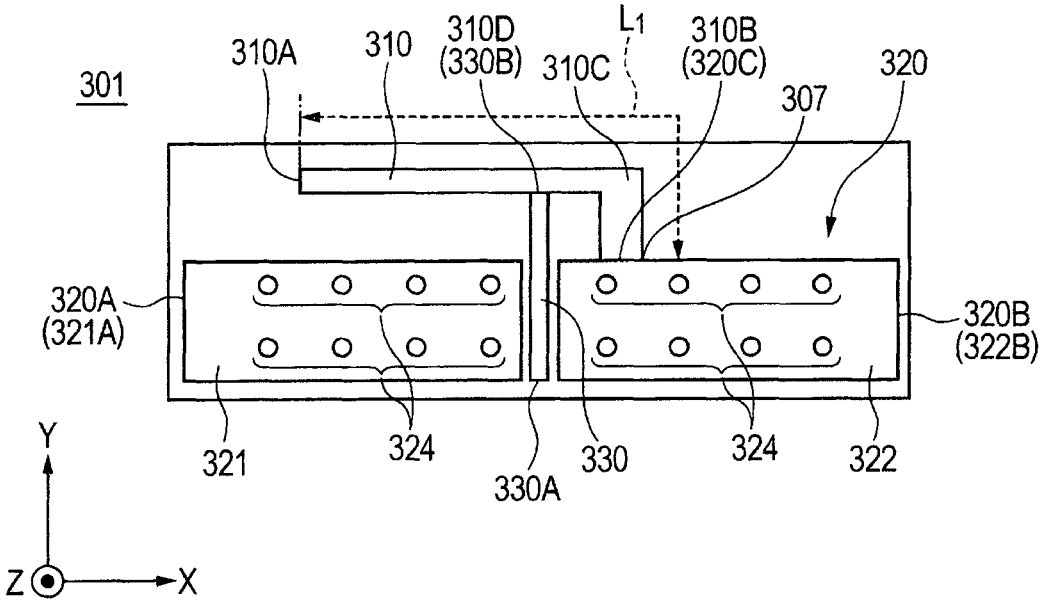
FIG. 3A is a plan view illustrating a first conductive layer of a printed wiring board constituting the antenna of the first embodiment of the present invention.
Figure 3B:
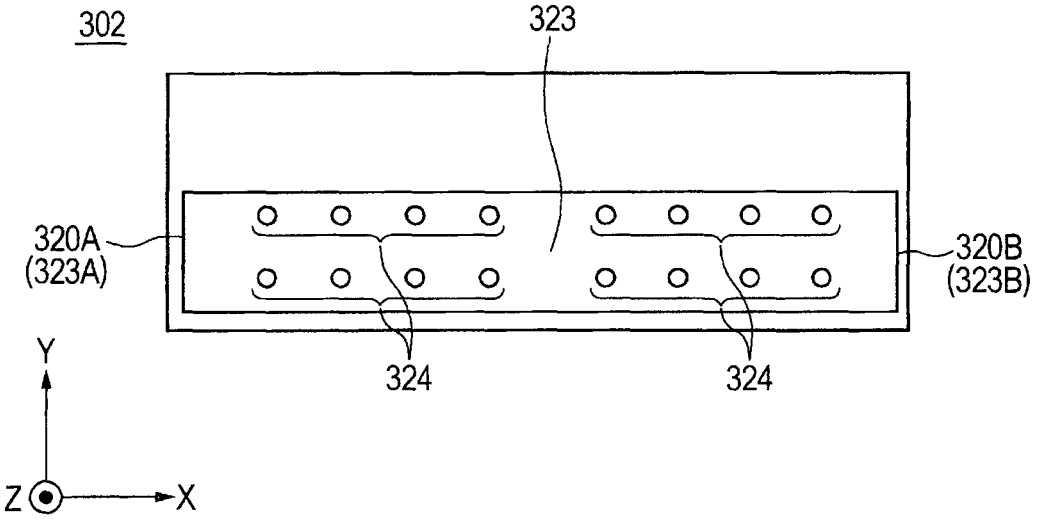
FIG. 3B is a plan view illustrating a second conductive layer of the printed wiring board constituting the antenna of the first embodiment of the present invention.

FIG. 3A is a plan view illustrating the conductive layer 301, which is a first conductive layer of the printed wiring board constituting the antenna 300. FIG. 3B is a plan view illustrating the conductive layer 302, which is a second conductive layer of the printed wiring board constituting the antenna 300. That is, FIGS. 3A and 3B are diagrams illustrating the antenna 300 in the vertical direction (the facing direction from the side of the antenna 300 toward the side of the metal member 400: −Z direction) that is perpendicular to the surface of the metal plate 401 illustrated in FIG. 2. The area of the external shape of the metal member 400 as viewed in the −Z direction is larger than the area of the external shape of the antenna 300.

The ground conductor 320 includes a ground pattern 321 that is formed on the conductive layer 301 and serves as a first ground pattern, and a ground pattern 322 that is formed on the conductive layer 301 and serves as a second ground pattern. The ground conductor 320 includes a ground pattern 323 that is formed on the conductive layer 302 and serves as a third ground pattern. The ground conductor 320 has a plurality of vias 324 that connect the ground patterns 321 and 322 and the ground pattern 323 to each other. Consequently, the ground pattern 323 is conducted with the ground patterns 321 and 322 through the vias 324. The ground patterns 321 and 322 are arranged on both sides in the X direction intersecting with (orthogonal to) the wiring direction (Y direction) of the signal line 330. The ground patterns 321 and 322 are formed to have external quadrangular shapes (more specifically, external rectangular shapes) as viewed in the −Z direction. The ground pattern 323 is formed to have external quadrangular shapes (more specifically, external rectangular shapes) including the ground patterns 321 and 322 as viewed in the −Z direction.

The ground pattern 321 serving as the first ground pattern, and the ground pattern 322 serving as the second ground pattern may be directly connected to each other on the conductive layer 301 serving as the first conductive layer by jumper components without intervention of the vias 324. Electric connection therebetween can be achieved by reducing the wiring length of the signal line 330, described later, or routing the wiring to another conductive layer through the vias.

The ground conductor 320 includes an end 320A serving as a first end in the X direction, and an end 320B serving as a second end in the X-direction opposite to the end 320A. What is relatively close to the one end 310A of the antenna element 310 between the pair of ends 320A and 320B is the end 320A. That is, the antenna element 310 is formed to be bent and have an L-shape on the side close to the end 320A. The +Y direction is a wiring direction of the antenna 310 extending from the other end 310B to the bent portion 310C of the antenna element 310.

In this embodiment, the ground conductor 320 includes the pair of ground patterns 321 and 322 arranged on both sides of the signal line 330 in the X direction, and the ground pattern 323 extending in the X direction. The ground pattern 323 includes an end 323A in the X direction, and an end 323B on the opposite side of the end 323A in the X-direction.

The ground pattern 321 includes an end 321A on the side opposite to the side adjacent to the signal line 330 in the X direction. The ground pattern 322 includes an end 322B on the side opposite to the side adjacent to the signal line 330 in the X direction. As viewed in the −Z direction, the end 323A of the ground pattern 323 can overlap with the end 321A of the ground pattern 321. As viewed in the −Z direction, the end 323B of the ground pattern 323 can overlap with the end 322B of the ground pattern 322.

Consequently, the end 320A of the ground conductor 320 is any of the end 321A of the ground pattern 321 and the end 323A of the ground pattern 323. Consequently, the end 320B of the ground conductor 320 is any of the end 322B of the ground pattern 322 and the end 323B of the ground pattern 323.

The case is thus described where the end 321A overlaps with the end 323A as viewed in the −Z direction. Alternatively, in the case where one of the ends projects in the −X direction, the projecting end serves as the end 320A of the ground conductor 320. The case is thus described where the end 322B overlaps with the end 323B as viewed in the −Z direction. Alternatively, in the case where one of the ends projects in the +X direction, the projecting end serves as the end 320B of the ground conductor 320.

In this embodiment, the number of conductive layers on the printed wiring board constituting the antenna 300 is two. Alternatively, the number of conductive layers may be three or more. In this case, the ground pattern 323 may be arranged on each conductive layer other than the conductive layer 301.

The dimension L1 of the L-shaped antenna element 310 in the longitudinal direction (signal propagation direction) is configured to have the length of ¼ of the wavelength λ of the communication frequency $f_1$ to efficiently emit electromagnetic waves.

Figure 25:
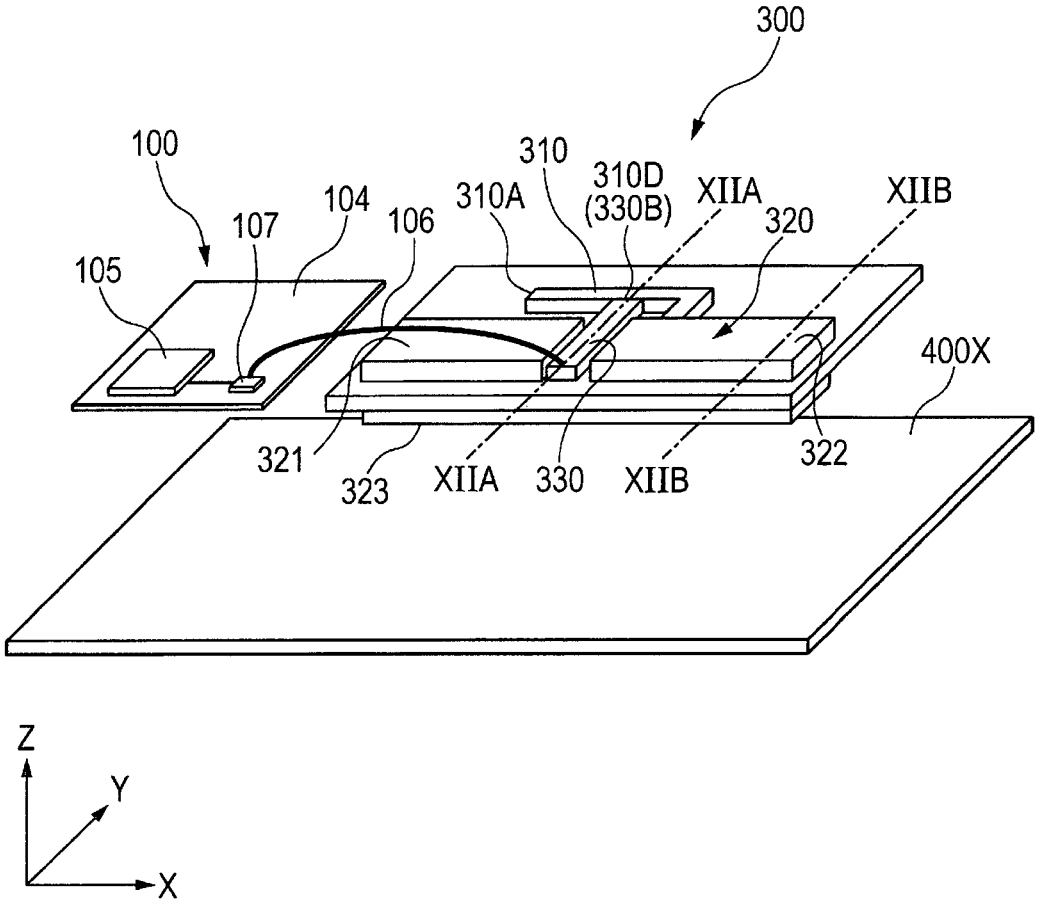
FIG. 25 is an exploded perspective view for illustrating the arrangement relationship between a printed circuit board, an antenna, and a metal member of the wireless communication device of a comparative example.

A wireless communication device in a comparative example is herein described. FIG. 25 is an exploded perspective view for illustrating the arrangement relationship between a printed circuit board, an antenna, and a metal member of the wireless communication device of the comparative example. A metal member 400X illustrated in FIG. 25 is different from the metal member 400 of this embodiment. That is, the metal member 400X of the comparative example corresponds to the metal plate 401 of this embodiment, and is a metal plate that does not include any projection corresponding to the projection 402. A printed circuit board 100 and an antenna 300 in the comparative example have the same configurations of the printed circuit board 100 and the antenna 300 of this embodiment.

Figure 26A:
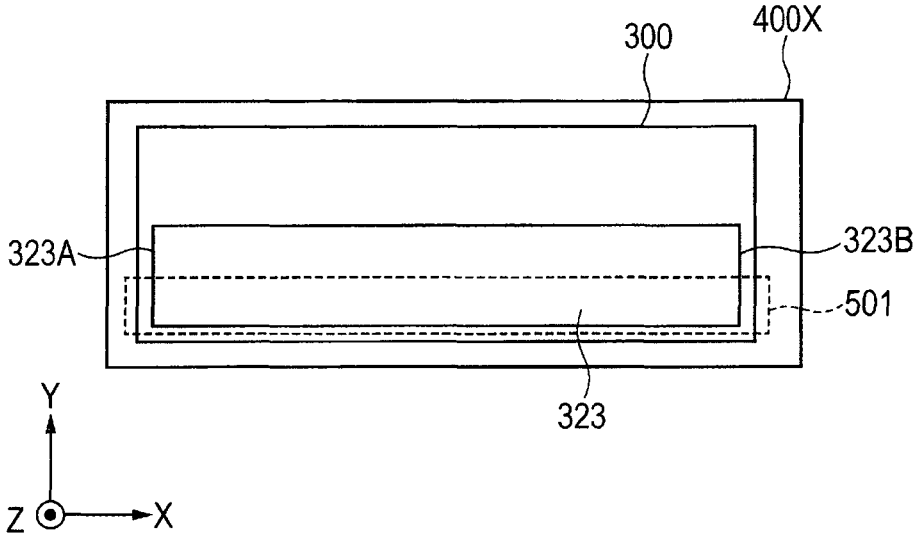
FIG. 26A is a schematic diagram illustrating the positional relationship between the ground pattern of the antenna and the metal member in the comparative example.
Figure 26B:
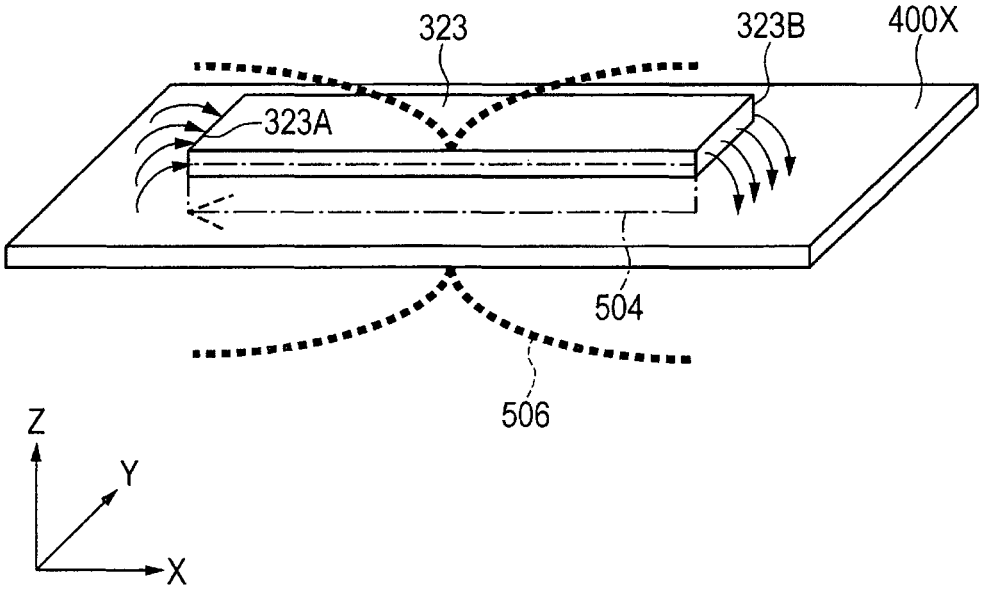
FIG. 26B is a schematic diagram illustrating a near electric field formed at both of the ground pattern of the antenna and the metal member in the comparative example.

FIG. 26A is a schematic diagram illustrating the positional relationship between the ground pattern 323 of the antenna 300 and the metal member 400X in the comparative example. FIG. 26B is a schematic diagram illustrating a near electric field formed at both of the ground pattern 323 and the metal member 400X in a region 501 encircled by broken lines.

In the case of arranging the metal member 400X close to the antenna 300, capacitive coupling due to electric lines of force as illustrated by arrows in FIG. 26B occurs between the ends 323A and 323B of the ground pattern 323 and the metal member 400X, and a resonance phenomenon occurs at a prescribed frequency.

In FIG. 26B, according to the electric field distribution 506 illustrated by broken lines, the electric field is weak at the center of the ground pattern 323 and strong at both the ends 323A and 323B. Consequently, in FIG. 26B, a path 504 illustrated by an alternate long and short dashed line serves as a loop-shaped antenna. This loop resonates at a frequency where the path length around the loop is the wavelength λ'.

In the case where the length (λ'/2) between the ends 323A and 323B of the ground pattern 323 is ½ or less of the wavelength λ of the communication frequency (λ'<λ), the resonance phenomenon occurs at higher frequency than the resonant frequency of the antenna 300. On the contrary, in the case where the length (λ'/2) between the ends 323A and 323B of the ground pattern 323 is ½ or more of the wavelength λ of the communication frequency (λ'>λ), the resonance phenomenon occurs at a lower frequency than the resonant frequency of the antenna 300.

Figure 27:
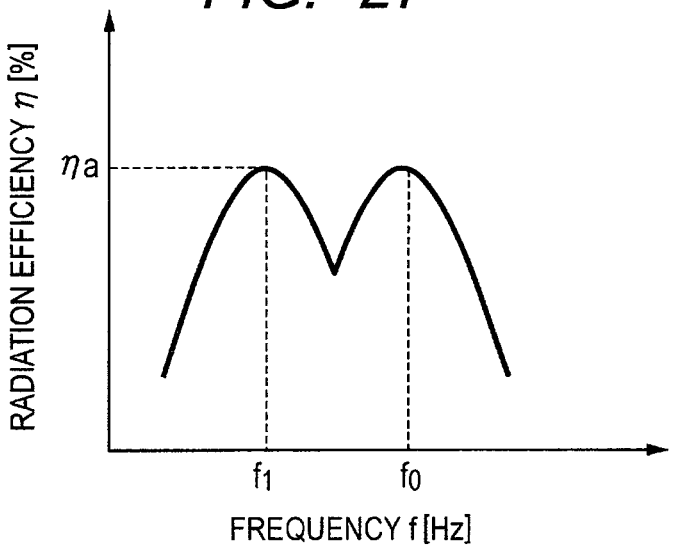
FIG. 27 is a graph illustrating a radiation efficiency of the antenna with respect to the frequency in the state of resonance at a higher frequency than a communication frequency.

FIG. 27 is a graph illustrating a radiation efficiency of the antenna 300 with respect to the frequency in the state of resonance at a higher frequency $f_0$ than a communication frequency $f_1$. As illustrated in FIG. 27, the energy dissipates between the communication frequency $f_1$ and the resonant frequency $f_0$ of the path 504, and the radiation efficiency is reduced. The radiation efficiency at the communication frequency $f_1$ is $\eta_a$.

Figure 28A:
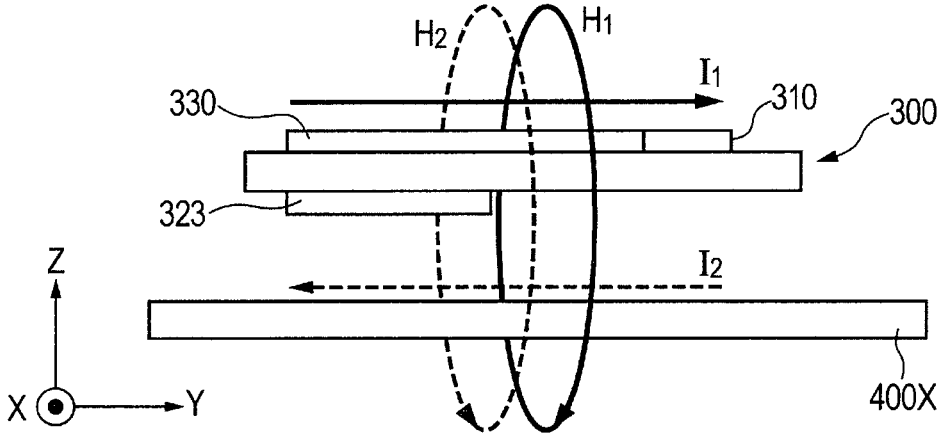
FIG. 28A is a schematic diagram illustrating the situations of the current and magnetic field at the sections of the antenna and the metal member taken along line XIIA of FIG. 25 as viewed in the −X direction.
Figure 28B:
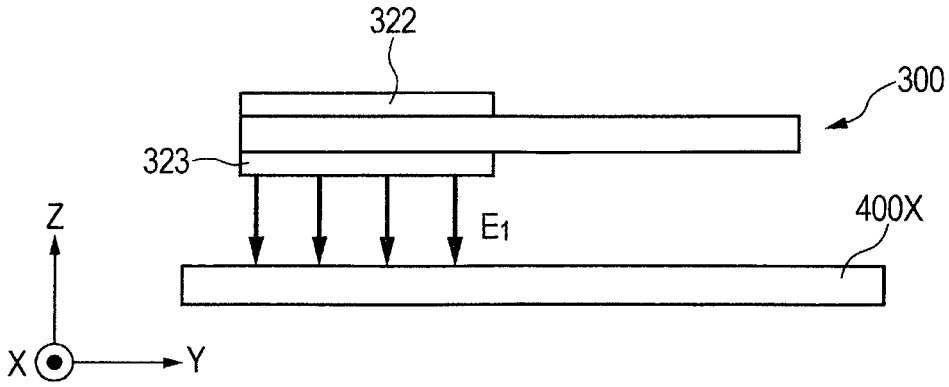
FIG. 28B is a schematic diagram illustrating the situations of the current and magnetic field at the sections of the antenna and the metal member taken along line XIIB of FIG. 25 as viewed in the −X direction.

FIG. 28A is a schematic diagram illustrating the situations of the current and magnetic field at the sections of the antenna 300 and the metal member 400X taken along line XIIA of FIG. 25 as viewed in the −X direction. FIG. 28B is a schematic diagram illustrating the situations of the current and magnetic field at the sections of the antenna 300 and the metal member 400X taken along line XIIB of FIG. 25 as viewed in the −X direction. That is, FIGS. 28A and 28B illustrate sectional views (YZ plane) of the antenna 300 and the metal member 400X as viewed in the −X direction.

In FIG. 28A, current $I_1$ strongly flows in the signal line 330, and a magnetic field $H_1$ occurs in a right-handed screw direction with respect to the current $I_1$. In the case of linkage of the magnetic field $H_1$ with the metal member 400X, current $I_2$ occurs in a direction preventing variation in the magnetic field $H_1$ owing to Faraday's law. A magnetic field $H_2$ then occurs in the right-handed screw direction with respect to the current $I_2$. Here, the current $I_1$ and the current $I_2$ have different signs. The magnetic fields $H_1$ and $H_2$ have different signs accordingly, and are canceled by each other. At this time, the entire inductance L between the antenna 300 and the metal member 400X is represented by the following Expression (1) using the self-inductance $L_{ANT}$ of the antenna 300 and the mutual inductance M between the antenna 300 and the metal member 400X.

$$L=L_{ANT}-M \qquad \text{Expression (1)}$$

The above Expression (1) means that occurrence of the cancellation magnetic field $H_2$ causes the mutual inductance M to function as a negative value. At this time, the entire inductance L becomes smaller in comparison with the case without the metal member 400X. Consequently, the resonant frequency $f_0=1/(2\times\pi\times\sqrt{(L\times C)})$ (C: capacitance) is shifted to a higher frequency.

In FIG. 28B, according to the ground pattern 323, the electric field is strong. When the metal member 400X becomes close, an electric field $E_1$ from an originating point of the ground pattern 323 is capacitively coupled where the metal member 400X is the terminal point. Thus, the capacitance C between the antenna 300 and the metal member 400X becomes high. Consequently, the resonant frequency $f_0=1/(2\times\pi\times\sqrt{(L\times C)})$ is shifted to a lower frequency.

As described above, in the case where the metal member 400X is close to a place where the magnetic field of the antenna 300 is strong, the resonant frequency is shifted to a high frequency range. In the case where the metal member 400X is close to a place where the electric field of the antenna 300 is strong, the resonant frequency is shifted to a low frequency range.

Consequently, to shift the resonant frequency $f_0$ between the antenna 300 and the metal member 400 to the communication frequency $f_1$, any of the aforementioned inductance L or the capacitance C is required to be high.

In this embodiment, the projection 402 is arranged at a position where this projection does not overlap with the signal line 330 but overlaps with the end 320B (322B) as viewed in the −Z direction.

Figure 4A:
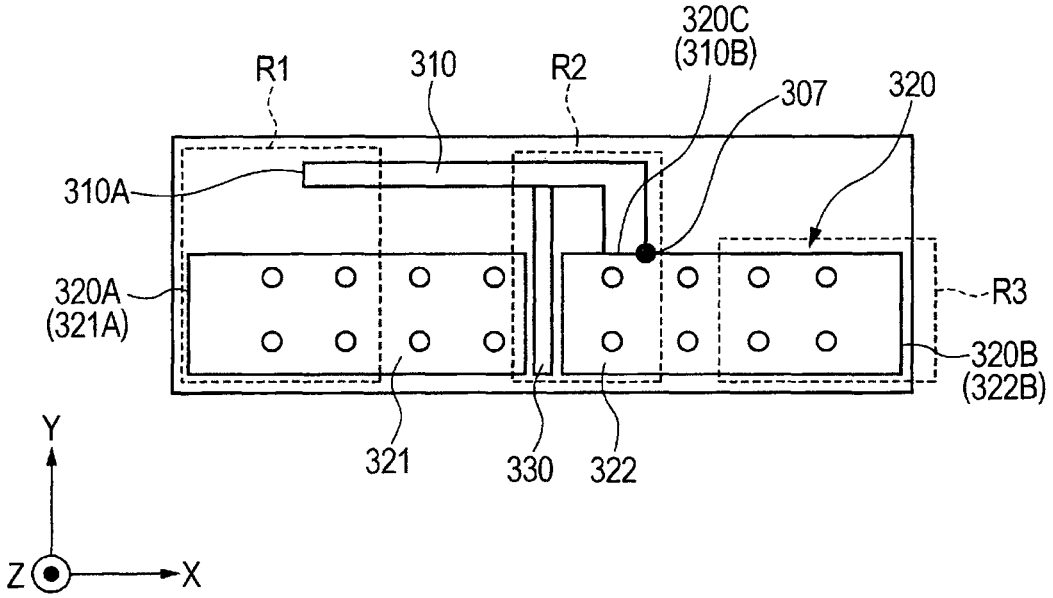
FIG. 4A is a diagram illustrating a region where any of the electric field intensity and/or the magnetic field intensity is high at the antenna when the antenna according to the first embodiment of the present invention is viewed in the −Z direction.

FIG. 4A is a diagram illustrating a region where the electric field intensity and/or the magnetic field intensity at the antenna 300 is high when this antenna 300 is viewed in the −Z direction. A region including the end 321A of the ground pattern 321 on the side opposite to the ground pattern 322 and the open end of the antenna element 310 is defined as a region R1. The region R1 is a region with a high electric field intensity and a high magnetic field intensity, because a strong electric field is emitted from the one end 310A, which is the open end of the antenna element 310, and is coupled with the ground pattern 321 to flow strong current.

A region including the connection portion 320C with the antenna element 310 in the ground pattern 322 is defined as a region R2. The region R2 can include a region including the signal line 330 and the end of the ground pattern 322 on the side of the ground pattern 321, and a region from the connection portion 320C with the ground pattern 322 of the antenna element 310 to a connector of the antenna element 310 with the signal line 330. In the region R2, a closed loop is formed where the signal line 330, the antenna element 310 and the ground pattern 322 are short-circuited. Consequently, in the region, the impedance becomes low, which causes current to strongly flow, and the magnetic field intensity is significantly higher than the electric field intensity. That is, the region R2 on the surface 300A of the antenna 300 is a region where the ratio (E/H) of the electric field intensity E to the magnetic field intensity H has the minimum value.

A region including the end 320B of the ground pattern 322 on the side opposite to the ground pattern 321 is defined as a region R3. The region R3 is at a position apart from the antenna element 310 and the signal line 330, and has a high impedance. Consequently, in this region, the electric field intensity is much significantly higher than the magnetic field intensity. That is, the region R3 on the surface 300A of the antenna 300 is a region where the ratio (E/H) of the electric field intensity E to the magnetic field intensity H has the maximum value.

Figure 4B:
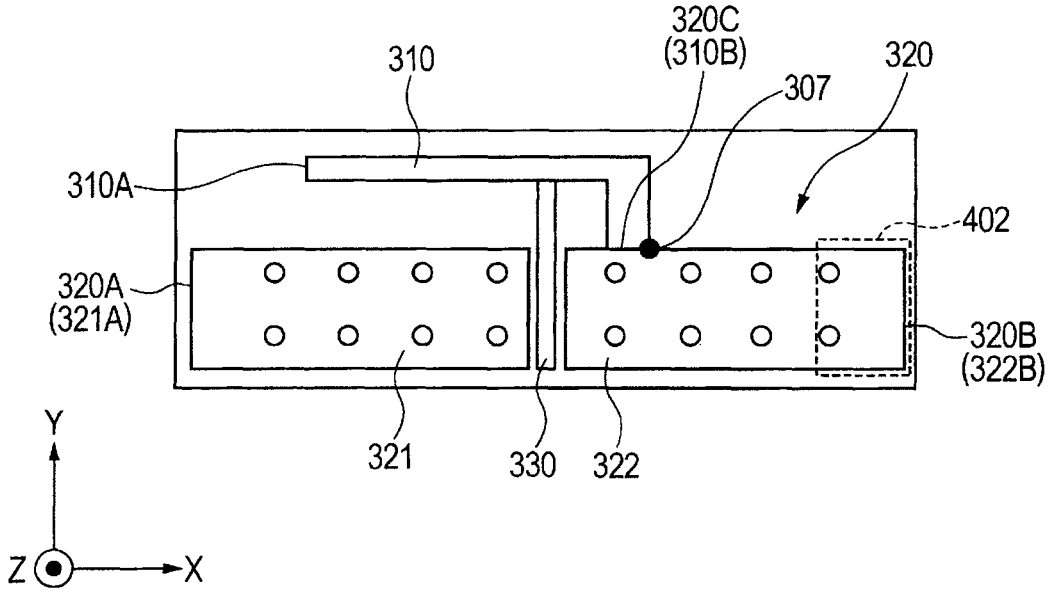
FIG. 4B is a diagram illustrating the positional relationship between the antenna and a projection in the first embodiment of the present invention.

FIG. 4B is a diagram illustrating the positional relationship between the antenna 300 and the projection 402. FIG. 4B illustrates a projection surface (XY plane) of FIG. 1 as viewed in the −Z direction. The external shape of the projection 402 is indicated by broken lines. The projection 402 is arranged at a position where the projection does not overlap with the signal line 330 but overlaps with the end 320B (322B) as viewed in the −Z direction. That is, the projection 402 is arranged in a region from the end 322B of the ground pattern 322 to an endpoint 307 of the connection portion 320C on the side close to the end 322B, the region overlapping with the ground conductor 320.

The projection 402 of the metal member 400 is arranged close to the antenna 300, thereby varying the resonant frequency.

Figure 5:
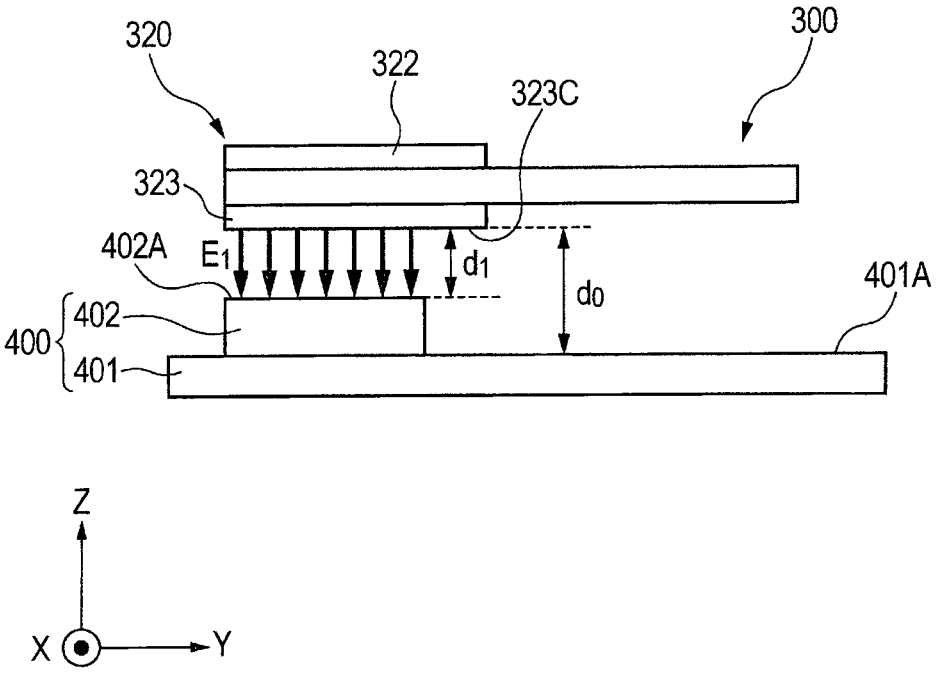
FIG. 5 is a schematic diagram illustrating the situation of the electric field between the antenna and the metal member around a second end of a ground conductor in the wireless communication device according to the first embodiment of the present invention.

FIG. 5 is a schematic diagram illustrating the situation of the electric field between the antenna 300 and the metal member 400 around the end 320B of the ground conductor 320 in the wireless communication device according to this embodiment. FIG. 5 illustrates a section (YZ plane) in the X direction.

The wireless communication device 202 of this embodiment is provided with the projection 402, which increases the amount of coupling of the electric field $E_1$ to the metal plate 401. Consequently, the capacitance C between the antenna 300 and the metal member 400 can be increased.

Here, the projection 402 has a surface 402A on the side facing the ground conductor 320. The ground conductor 320 (the ground pattern 323 in this embodiment) has a surface 323C facing the metal member 400. The gap between the projection 402 and the ground conductor 320 in the Z direction, that is, the distance in the Z direction between the surface 402A of the projection 402 and the surface 323C of the ground conductor 320 is defined as $d_1$. The gap between the metal plate 401 and the ground conductor 320 in the Z direction, that is, the distance in the Z direction between the surface 401A of the metal plate 401 and the surface 323C of the ground conductor 320 is defined as $d_0$. The gap $d_1$ in the Z direction between the projection 402 and the ground conductor 320 is configured to be smaller than the gap $d_0$ in the Z direction between the metal plate 401 and the ground conductor 320, thereby allowing the capacitance C to be high.

At this time, the inductance L becomes low because of the arrangement of the projection 402. However, in proximity to the end 320B, the magnetic field intensity is relatively lower than the magnetic field intensity at another position. Consequently, even if the gap with the ground conductor 320 is small at the projection 402, the amount of reduction in the inductance L is small.

The resonant frequency $f_0=1/(2\times\pi\times\sqrt{(L\times C)})$ can therefore be low. The resonant frequency $f_0$ illustrated in FIG. 27 can be reduced and moved to the communication frequency $f_1$, and the radiation efficiency $\eta$ can be increased to be higher than $\eta_a$. As described above, due to the projection 402, when the signal waves are transmitted by the IC 105 through the antenna 300, the radiant quantity of radio waves at the communication frequency can be increased without increasing the supply power. When the IC 105 receives signal waves through the antenna 300, the amount of reception of the signal waves at the communication frequency can be increased, which can negate the need to increase the amplification degree of the received signal, and can reduce the power consumption of the wireless communication device 202. Thus, the capacitive coupling between the antenna 300 and the metal member 400 is strengthened at a place where the ratio of the electric field intensity to the magnetic field intensity of the antenna 300 is high. The resonant frequency $f_0$ between the antenna 300 and the metal member 400 is shifted toward the communication frequency $f_1$. Consequently, the transmission and reception gains (communication gain, i.e., communication characteristics) at the communication frequency $f_1$ are improved.

That is, increase in the value (inductance L×capacitance C) between metal plate 401 and the ground conductor 320 can reduce the resonant frequency $f_0$. In the region R1 or R3 where the electric field intensity is high, the capacitance C is dominant. Consequently, the capacitance C in the region R1 and/or R3 is configured to be high in the first embodiment.

Example 1

As Example 1, a result of execution of a three-dimensional electromagnetic simulation for the wireless communication device 202 illustrated in FIG. 1 is described. The calculation was performed using the three-dimensional electromagnetic simulator MW-STUDIO by CST. The antenna 300 was represented as a simulation model formed of a four-layer printed wiring board.

Figure 6A:
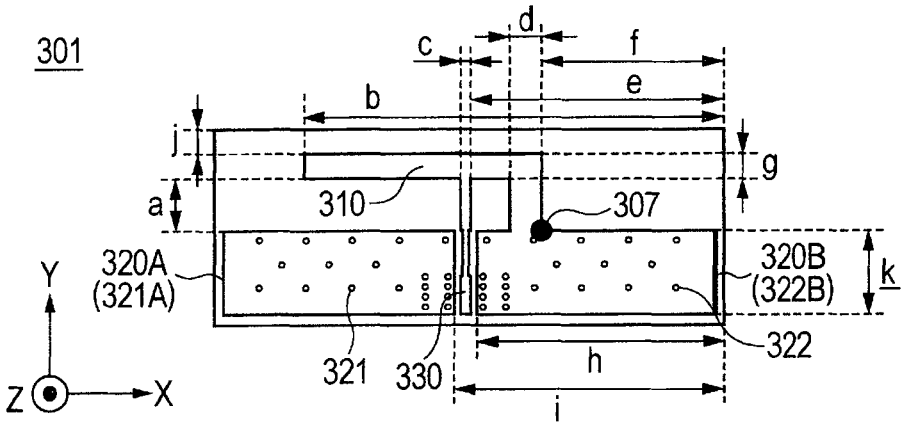
FIG. 6A is a plan view illustrating a simulation model of the first conductive layer of the antenna of Example 1.
Figure 6B:
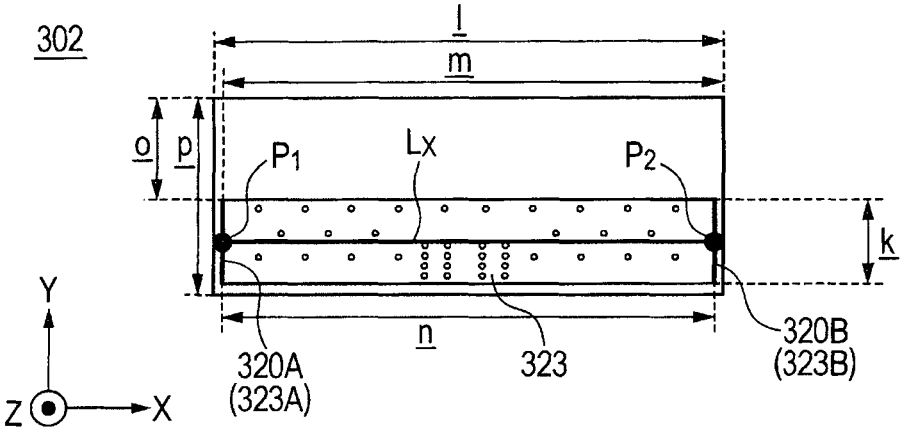
FIG. 6B is a plan view illustrating a simulation model of the second, third and fourth conductive layers of the antenna of Example 1.
Figure 6C:
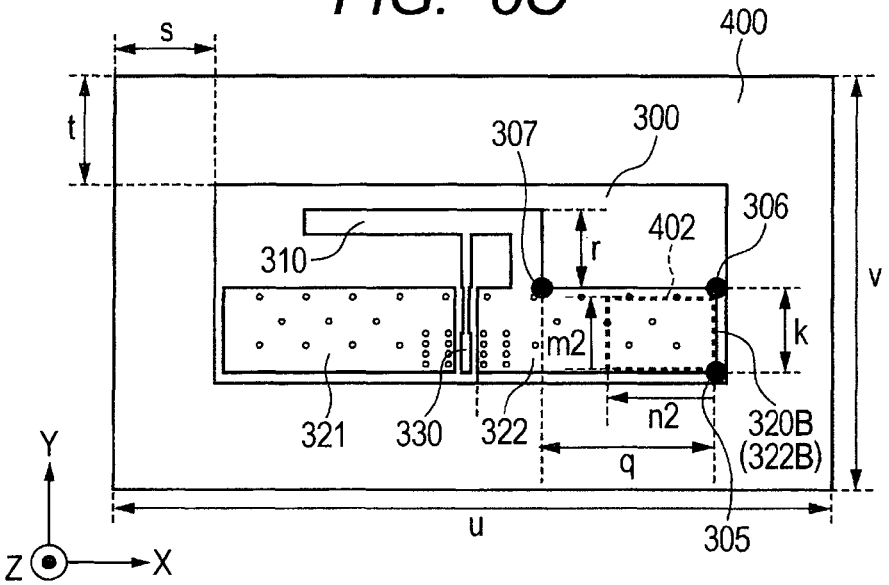
FIG. 6C is a plan view illustrating the positional relationship of a simulation model of the antenna and the metal member of Example 1.

FIG. 6A is a plan view illustrating a simulation model of the first conductive layer of the antenna 300. FIG. 6B is a plan view illustrating a simulation model of the second, third and fourth conductive layers of the antenna 300. FIG. 6C is a plan view illustrating the positional relationship of a simulation model of the antenna 300 and the metal member 400.

The thickness of wiring was set to 35 [μm]. The inter-layer distance between the first and second layers and that between the third and fourth layers were set to 0.2 [mm]. The inter-layer distance between the second and third layers was set to 0.91 [mm]. The thickness of the dielectric substance was set to 1.345 [mm]. The dielectric substance was made of FR4 (relative dielectric constant of 4.3). The wiring was made of copper (conductivity of $5.8\times10^7$ [S/m]). The thickness of the metal plate 401 was set to 0.5 [mm]. The metal plate 401 was made of SUS304 (conductivity of $1.39\times10^6$ [S/m]). The gap $d_0$ between the antenna 300 and the metal plate 401 (FIG. 5) was set to 2.0 [mm].

The dimension values of elements indicated by alphabetical letters in FIGS. 6A to 6C are described below. The dimension values of elements illustrated in FIG. 6A are a=5.3 [mm], b=41.8 [mm], c=0.9 [mm], d=3.0 [mm], e=25.0 [mm], f=18.0 [mm], g=2.5 [mm], and h=24.4 [mm]. Furthermore, i=26.5 [mm], j=2.4 [mm], and k=8.5 [mm]. The dimension values of elements illustrated in FIG. 6B are l=50.9 [mm], m=50.0 [mm], n=49.1 [mm], o=10.2 [mm], and p=19.8 [mm]. The dimension values of elements illustrated in FIG. 6C are q=17.1 [mm], r=7.8 [mm], s=15.0 [mm], t=15.0 [mm], u=80.9 [mm], and v=49.8 [mm].

First, in the wireless communication device 202 of Example 1, the arrangement position of the projection 402 that can improve the radiant quantity of radio waves at the communication frequency $f_1$ is described. The projection 402 is required to be arranged to overlap at the place where the electric field intensity of the antenna 300 is high and the magnetic field intensity is low. Consequently, the projection 402 is arranged at a position where the wave impedance E/H[Ω], which is the ratio of the electric field intensity E[V/m] to the magnetic field intensity H [A/m], is high as viewed in the −Z direction.

Figure 7:
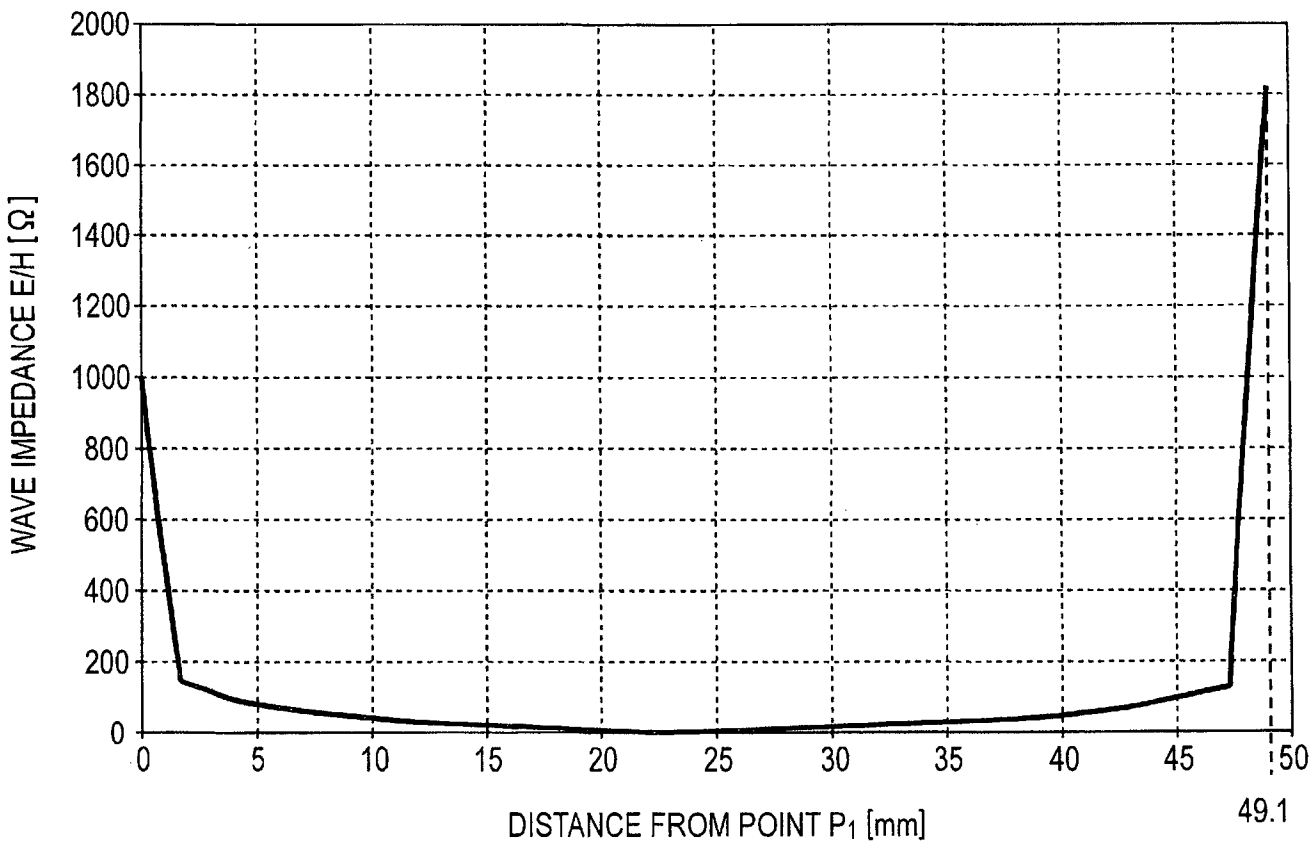
FIG. 7 is a graph illustrating the value of wave impedance in Example 1.

FIG. 7 is a graph illustrating a simulation result, and a graph illustrating the value of wave impedance with respect to the distance from the point $P_1$ to the point $P_2$ in the +X direction on the solid line $L_X$ on the ground pattern 323 in FIG. 6B. As illustrated in FIG. 7, when the distance from the point $P_1$ increases, the wave impedance decreases. When the distance exceeds 25 [mm], the wave impedance increases again. At the position with the distance of 49.1 [mm], i.e., at the point $P_2$, the wave impedance (E/H) is 1820 [Ω], which is the maximum value. That is, a point where the wave impedance (E/H) on the ground pattern 323 is the maximum value is the end 323B.

Consequently, the projection 402 is arranged at the end 320B of the ground conductor 320, i.e., the position overlapping with the end 323B of the ground pattern 323, as viewed in the −Z direction.

The projection 402 can be entirely overlaid on the end 320B as viewed in the −Z direction. However, the configuration is not limited thereto. Alternatively, the arrangement may slightly deviate from the end 320B. That is, the range of the arrangement position of the projection 402 with respect to the end 320B may be in a range where the wave impedance (E/H) is higher than the value at the end 323A of the ground pattern 323.

The wave impedance at the end 323A is 994 [Ω] at the distance 0 [mm] as illustrated in FIG. 7. Consequently, the range of the wave impedance E/H is represented by the following Expression (2).

$$1000[\Omega] \le \frac{E}{H} \le 1820[\Omega] \qquad \text{Expression (2)}$$

The wave impedance at the end 320B (323B) is regarded as $\eta_{MAX}$, Expression (2) is normalized, and the following Expression (3) is obtained.

$$0.55\cdot\eta_{MAX} \le \frac{E}{H} \le \eta_{MAX} \qquad \text{Expression (3)}$$

That is, the projection 402 is arranged at the position of at least partially overlapping with the region of the antenna 300 where the ratio (E/H) of the electric field intensity E to the magnetic field intensity H is 0.55 or more times and 1.0 or less times as high as the maximum value $\eta_{MAX}$ as viewed in the −Z direction. This range is a range to a position approximately 1 [mm] apart from the end 323B in the −X direction in FIG. 6B.

Next, in the wireless communication device 202 of Example 1, the shape of the projection 402 that can improve the radiant quantity of radio waves at the communication frequency $f_1$ is described. The wireless communication device of the comparative example illustrated in FIG. 25 was also modeled as with Example. The difference from the simulation model in Example 1 is only in that the projection 402 is not included in FIG. 6C. The dimensions of other elements were configured to be analogous. As to each of the models of Example 1 and the comparative example, the power to be supplied to the antenna 300 was configured to be 100 [mW], and the communication frequency was configured to be 2.45 [GHz], and the entire radiant power [mW] emitted from the antenna 300 was obtained.

Figure 8A:
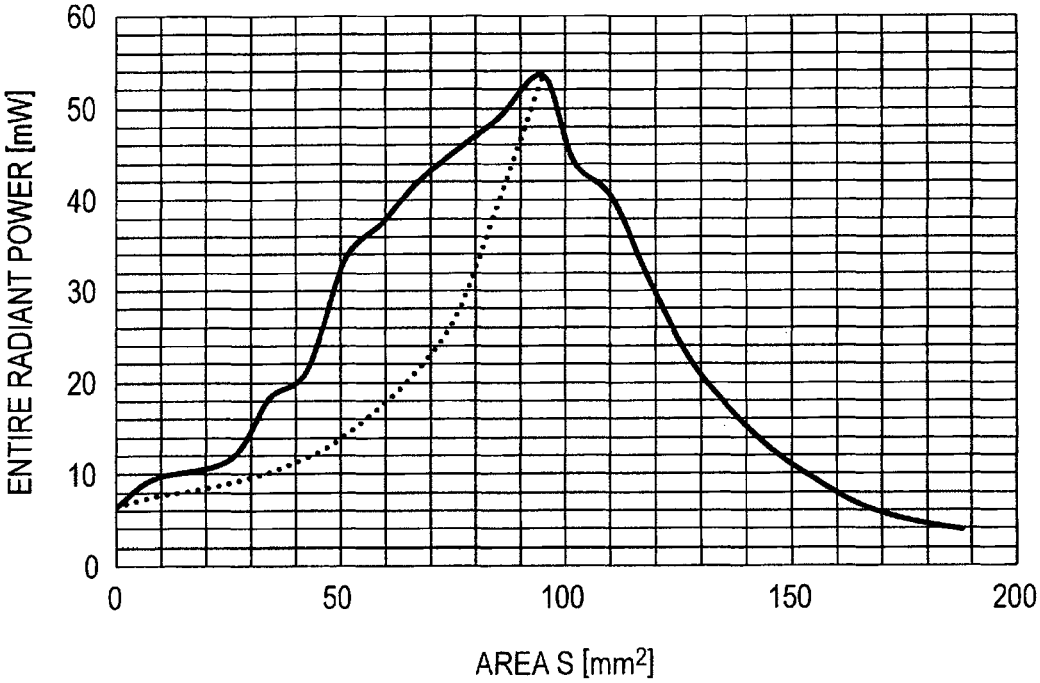
FIG. 8A is a graph illustrating the entire radiant power of the antenna with respect to an area S in Example 1.

FIG. 8A is a graph illustrating the entire radiant power of the antenna 300 with respect to the area S (the area of the projection 402 in this embodiment) of an overlapping portion between the projection 402 and the ground conductor 320 (ground pattern 323) as viewed in the −Z direction. The gap $d_1$ between the antenna 300 and the projection 402 (FIG. 5) was fixed to 1.0 [mm]. In FIG. 6C, the value of the entire radiant power [mW] in the case where the area S of the overlapping portion between the projection 402 and the ground pattern 323 as viewed in the −Z direction was changed was observed.

In FIG. 8A, the solid line represents the characteristics (simulation result) in the case where the longitudinal length m2 of the projection 402 in FIG. 6C is fixed to 8.5 [mm] while changing the lateral direction n2. In FIG. 8A, the broken line represents the characteristics (simulation result) in the case where the lateral length n2 of the projection 402 in FIG. 6C is fixed to 11.2 [mm] while changing the longitudinal direction m2 to a point 306.

Here, the projection 402 is entirely overlaid on the ground conductor 320 (ground pattern 323) as viewed in the −Z direction. Consequently, the area S is also the area of the projection 402 as viewed in the −Z direction.

The entire radiant power in the case where the projection 402 has an area S=0 is a calculation result of the comparative example, and had a value of 6.5 [mW]. In Example 1, the range having an advantageous effect at least twice higher than the entire radiant power of 6.5 [mW] of the comparative example is a range of 28 [$mm^2$]≤S≤145 [$mm^2$] indicated by the solid line and S≥48 [$mm^2$] indicated by the broken line.

The range in which both the ranges overlap and which has an advantageous effect at least twice higher than that of the comparative example is 48 [$mm^2$]≤S≤145 [$mm^2$]. As viewed in the −Z direction, the area of a rectangular region (region of k×q) having diagonal apices that are an endpoint 307 on the side close to the end 320B of the connection portion 320C and a corner 305 farthest from the antenna element 310 at the end 320B of the ground conductor 320 is $S_0$ [$mm^2$]. The range 48 [$mm^2$] S 145 [$mm^2$] is normalized with the area $S_0$ [$mm^2$] (=k×q=145 [$mm^2$]) in the range from the endpoint 307 of the connection portion 320C to the end 323B of the ground pattern 323 in FIG. 6C to obtain the range of Expression (4).

$$0.33 \cdot S_0 \leq S \leq S_0 \quad \text{Expression (4)}$$

That is, as viewed in the −Z direction, the area S can be in a range 0.33 or more times and 1.0 or less times as large as the area $S_0$ of the rectangular region.

The range having a specifically highly advantageous effect, which is at least five times higher than that of the comparative example, is a range defined by the solid line 50 [$mm^2$]≤S≤118 [$mm^2$] and the broken line S≥80 [$mm^2$] in FIG. 8A. The range in which both the ranges overlap with each other and which has an advantageous effect at least five time higher than that of the comparative example is 80 [$mm^2$]≤S≤118 [$mm^2$]. Likewise, the range is normalized with the area $S_0$ to obtain the range of Expression (5).

$$0.55 \cdot S_0 \leq S \leq 0.81 \cdot S_0 \quad \text{Expression (5)}$$

That is, as viewed in the −Z direction, the area S can be in a range 0.55 or more times and 0.81 or less times as large as the area $S_0$ of the rectangular region.

Figure 8B:
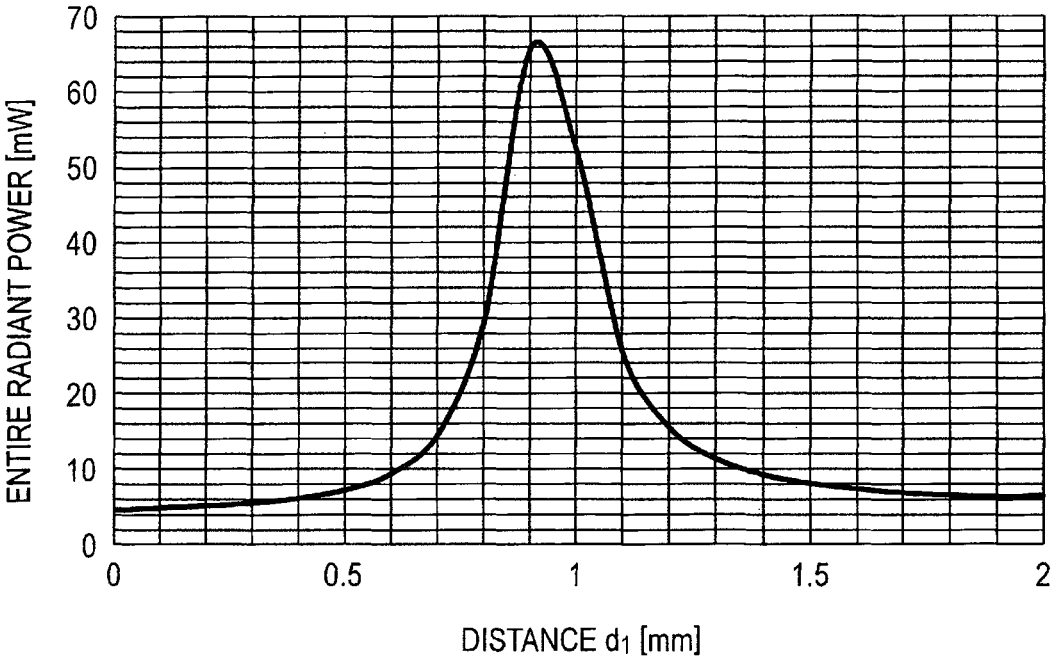
FIG. 8B is a graph illustrating the entire radiant power of the antenna with respect to a gap $d_1$ in Example 1.

FIG. 8B is a graph illustrating the entire radiant power of the antenna 300 with respect to the gap $d_1$ in the case where the gap $d_0$ is fixed and the gap $d_1$ is changed in Example 1.

In the simulation result of FIG. 8B, the entire radiant power [mW] is observed when the gap $d_0$ [mm] is fixed to 2.0 [mm] and the gap $d_1$ [mm] between the ground pattern 323 and the projection 402 is changed in the −Z direction. The graph illustrated in FIG. 8B represents the characteristics under the condition where the most advantageous effect is achieved in FIG. 8A and m2=8.5 [mm] and n2=11.2 [mm] (area S=95.2 [$mm^2$]) are fixed while changing the gap $d_1$, in FIG. 6C.

Here, the entire radiant power in the case where gap $d_1$=2.0 [mm] is the calculation result of the comparative example. The value is 6.5 [mW]. In Example 1, the range having an advantageous effect at least twice higher than the entire radiant power of 6.5 [mW] of the comparative example is a range of 0.68 [mm]≤$d_1$≤1.25 [mm]. This range is normalized with the gap $d_0$ [mm] (=2.0 [mm]) between the ground pattern 323 and the metal plate 401 in FIG. 5 to obtain the following Expression (6).

$$0.34 \cdot d_0 \leq d_1 \leq 0.63 \cdot d_0 \quad \text{Expression (6)}$$

That is, the gap $d_1$ can be in a range 0.34 or more times and 0.63 or less times as high as the gap $d_0$.

The range having a specifically highly advantageous effect, which is at least five times higher than that of the comparative example, is 0.82 [mm]≤$d_1$≤1.07 [mm]. Likewise, the range is normalized with the gap $d_0$ to obtain the range of Expression (7).

$$0.41 \cdot d_0 \leq d_1 \leq 0.54 \cdot d_0 \quad \text{Expression (7)}$$

That is, the gap $d_1$ can be in a range 0.41 or more times and 0.54 or less times as high as the gap $d_0$.

Here, the capacitance between the ground pattern 323 and the projection 402 is represented as $C_1=\varepsilon_0 \cdot S/d_1$ [F] using the gaps $d_0$ and $d_1$, the area S of the projection 402, and the permittivity of vacuum $\varepsilon_0$. The capacitance between the ground pattern 323 and the projection 402 is represented as $C_0=\varepsilon_0 \cdot S/d_0$ [F]. Here, the gaps $d_0$ and $d_1$, the area S of the projection 402, and the permittivity of vacuum $\varepsilon_0$ were used.

In the case where Expression (6) is represented using the capacitances $C_0$ and $C_1$, a range having an advantageous effect at least twice as high as that of the comparative example is represented by Expression (8).

$$1.6 \cdot C_0 \leq C_1 \leq 2.9 \cdot C_0 \quad \text{Expression (8)}$$

That is, the capacitance between the projection 402 and the ground conductor 320 is in a range 1.6 or more times and 2.9 or less times as high as the capacitance between the metal plate 401 and the ground conductor 320.

Likewise, in the case where Expression (7) is represented using the capacitances $C_0$ and $C_1$, a range having an advantageous effect at least five times as high as that of the comparative example is represented by Expression (9).

$$1.9 \cdot C_0 \leq C_1 \leq 2.4 \cdot C_0 \quad \text{Expression (9)}$$

That is, the capacitance between the projection 402 and the ground conductor 320 is in a range 1.9 or more times and 2.4 or less times as high as the capacitance between the metal plate 401 and the ground conductor 320.

As described above, the range in this Example that has an advantageous effect at least twice as high as that of the comparative example is defined by Expressions (4) and (8). The range that has an advantageous effect at least five times as high as that of the comparative example is defined by Expressions (5) and (9).

The present invention is not limited by the embodiment described above. Instead, various modifications can be made within the technical thought of the present invention. The advantageous effects described in the embodiments of the present invention can be only a list of advantageous effects exerted by the present invention. The advantageous effects by the present invention are not limited by the description in the embodiments of the present invention.

In the first embodiment, the shape of the projection 402 is described according to the case of having a rectangular shape as viewed in the −Z direction. However, the configuration is not limited thereto. Any of shapes, such as circular and polygonal shapes as viewed in the −Z direction, may be adopted.

In the first embodiment, the description has been made for the case where the antenna 300 is the inverted-F antenna. However, the configuration is not limited thereto. Alternatively, as long as the antenna 300 is a patterned antenna having a ground pattern arranged on the same plane as or a plane parallel to that of the antenna element, the present invention is applicable. For example, a monopole antenna may be adopted. In this case, it is only required that the projection is arranged at a position overlapping with the first end or the second end in a direction intersecting with the direction in which the antenna element of the ground conductor extends as viewed in the facing direction (−Z direction). That is, it is only required that one or both of the first end and the second end is provided with a projection.

In the first embodiment, the description has been made for the case where the metal member 400 includes the metal plate 401 and the projection 402. However, the configuration is not limited thereto. Alternatively, the metal member may have a planer shape, and the antenna may be arranged relatively inclined from the metal member.

In this case, the metal member and the antenna may be arranged such that the gap $d_1$ in the Z direction (facing direction) between the metal member and the second end of the ground conductor is smaller than the gap $d_0$ in the Z direction (facing direction) between the metal member and the first end of the ground conductor.

In this case, as with the first embodiment, the gap $d_1$ between the metal member and the second end of the ground conductor can be in a range that is 0.34 or more times or 0.63 or less times as large as the gap $d_0$ between the metal member and the first end of the ground conductor. Furthermore, as with the first embodiment, the gap $d_1$ between the metal member and the second end of the ground conductor can be in a range that is 0.41 or more times and 0.54 or less times as large as the gap $d_0$ between the metal member and the first end of the ground conductor.

In the first embodiment, the description has been made for the case where the electronic apparatus is an X-ray image diagnostic apparatus, which is an example of an imaging apparatus. However, the configuration is not limited thereto. For example, the imaging apparatus may be any of a digital camera and a smartphone. The present invention is applicable to any electronic apparatus other than the imaging apparatus.

According to the first embodiment, the capacitive coupling between the antenna and the metal member is strengthened at a place where the ratio of the electric field intensity to the magnetic field intensity of the antenna is high. The resonant frequency between the antenna and the metal member is thus shifted to the communication frequency, thereby improving the transmission and reception gains at the communication frequency.

Second Embodiment

Figure 9:
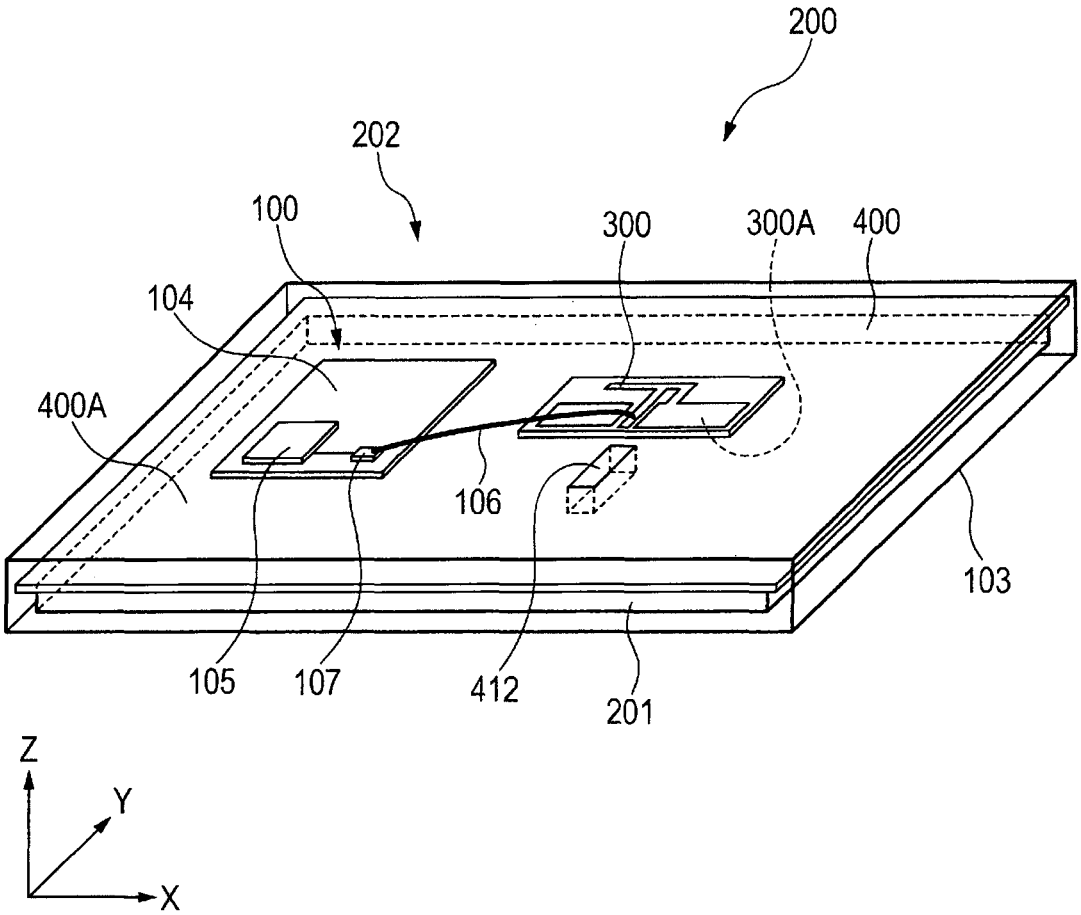
FIG. 9 is a diagram illustrating an X-ray image diagnostic apparatus, which is an example of an electronic apparatus including a wireless communication device according to a second embodiment of the present invention.
Figure 10:
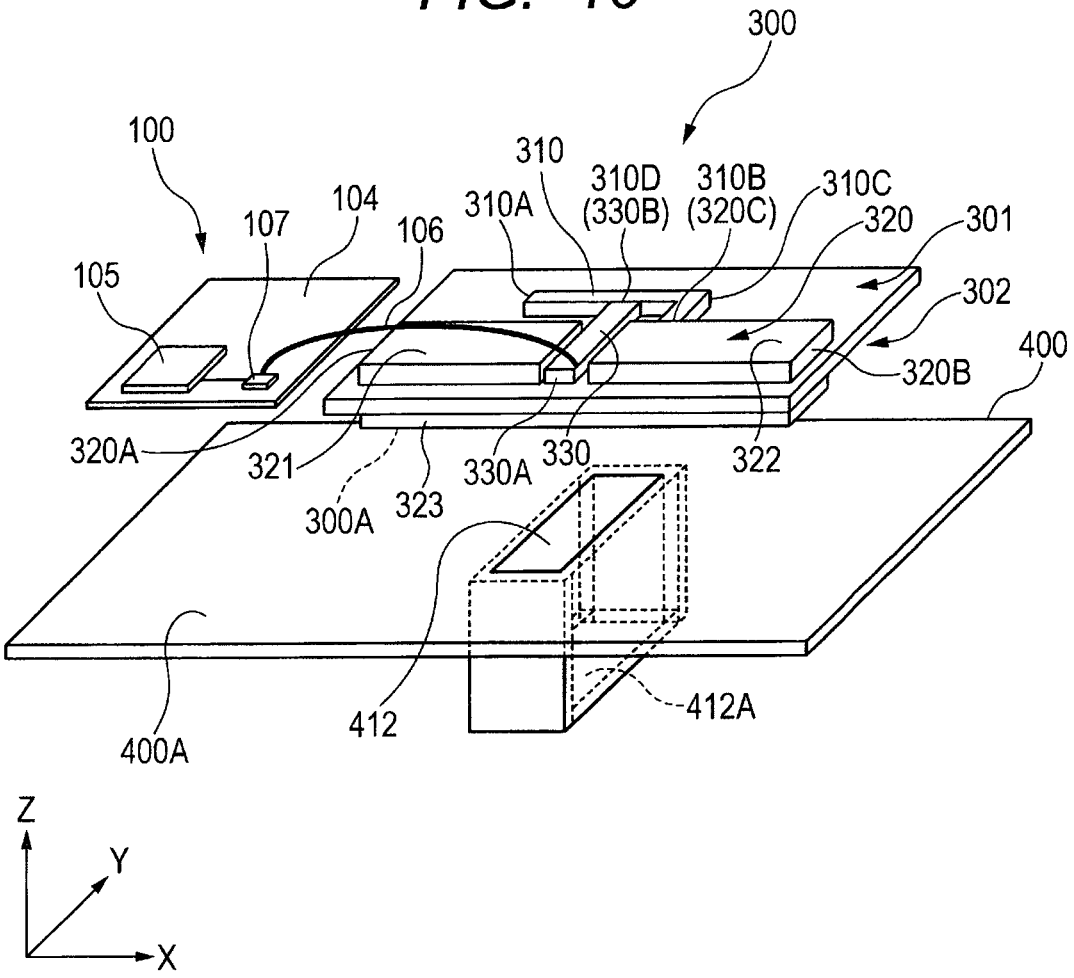
FIG. 10 is an exploded perspective view for illustrating the arrangement relationship between a printed circuit board, an antenna, and a metal member of the wireless communication device according to the second embodiment of the present invention.

Hereinafter, a second embodiment of the present invention is described in detail with reference to FIGS. 9 to 15B. The same members as those of FIGS. 1 to 8B illustrating the first embodiment are assigned the same symbols. The description thereof is omitted. FIG. 9 is a diagram illustrating an X-ray image diagnostic apparatus, which is an example of an electronic apparatus including a wireless communication device according to the second embodiment of the present invention. Here, the X, Y and Z directions illustrated in FIG. 9 are directions orthogonal to (intersecting with) each other. FIG. 10 is an exploded perspective view for illustrating the arrangement relationship between a printed circuit board, an antenna, and a metal member of the wireless communication device according to the second embodiment of the present invention.

In the second embodiment, as illustrated in FIGS. 9 and 10, instead of the projection 402 illustrated in FIGS. 1 and 2 pertaining to the first embodiment, a concave 412 is formed that has a rectangular shape as viewed in the −Z direction and is concaved in the −Z direction away from the antenna 300.

That is, the gap in the Z direction between the region R2 of the antenna 300 and a surface 400A of the metal member 400 is relatively larger than the gap in the Z direction between the region R3 of the antenna 300 and the surface 400A of the metal member 400. In this embodiment, the concave 412 is formed at a portion facing the region R2 on the surface 400A of the metal member 400.

Figure 11:
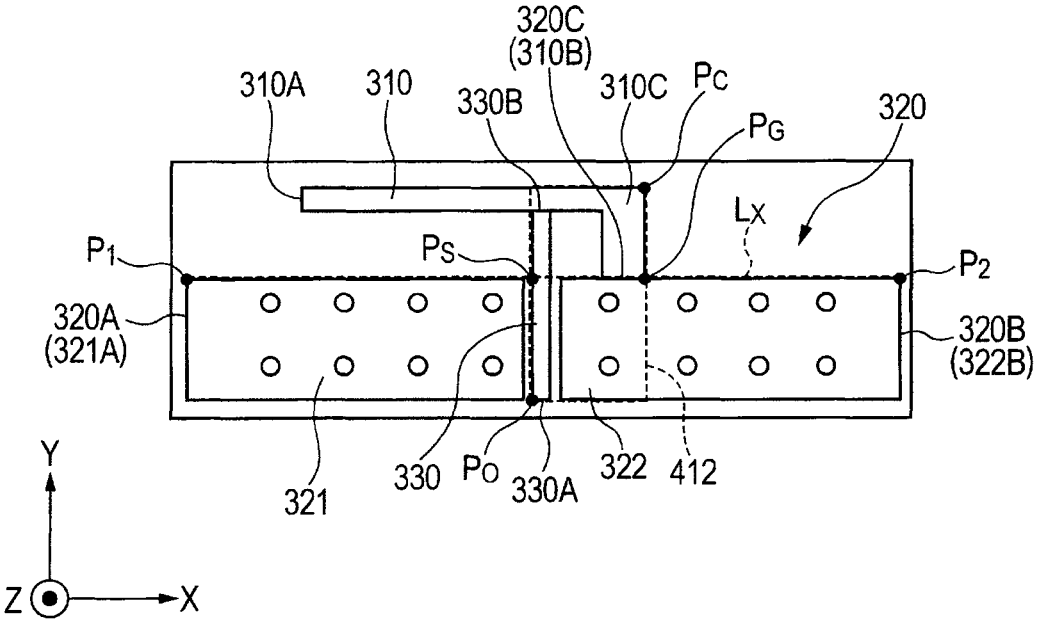
FIG. 11 is a diagram illustrating the positional relationship between the antenna and a concave in the second embodiment of the present invention.

FIG. 11 is a diagram illustrating the positional relationship between the antenna 300 and the concave 412. FIG. 11 illustrates a projection surface (XY plane) of FIG. 9 as viewed in the −Z direction. The external shape of the concave 412 is indicated by broken lines. The concave 412 is formed at a position overlapping with at least the part of the signal line 330, desirably the entire signal line 330, as viewed in the −Z direction.

More specifically, as viewed in the −Z direction, an endpoint of the end 330A of the signal line 330 on a side close to the end 320A (321A) is defined as $P_O$, and the apex at an external corner at the bent portion 310C of the antenna element 310 is defined as $P_O$. The concave 412 is formed to overlap with at least a part of (or entire) a rectangular region whose diagonal apices are $P_O$ and $P_C$ as viewed in the −Z direction. In FIG. 11, the external shape of the concave 412 coincides with the rectangular region. Here, the apex at a corner of the end 321A of the ground pattern 321 on a side close to the one end 310A of the antenna element 310 is defined as $P_1$. The apex at a corner of the ground pattern 322 between the end (end side) 322B and the end side on the side of the connection portion 320C is defined as $P_2$. The endpoint of the connection portion 320C on the side close to the end 320B (322B) is defined as $P_G$. The intersection on the side close to the end 320A (321A) among the intersections between the line $L_X$ connecting the point $P_1$ and the point $P_2$ and the end side of the signal line 330 is defined as $P_S$.

Thus, the concave 412 of the metal member 400 is arranged close to the antenna 300, thereby changing the resonant frequency. In this embodiment, the concave 412 is arranged (formed) at a position that shifts the resonant frequency $f_0$ toward the communication frequency $f_1$ as viewed in the −Z direction.

Figure 12:
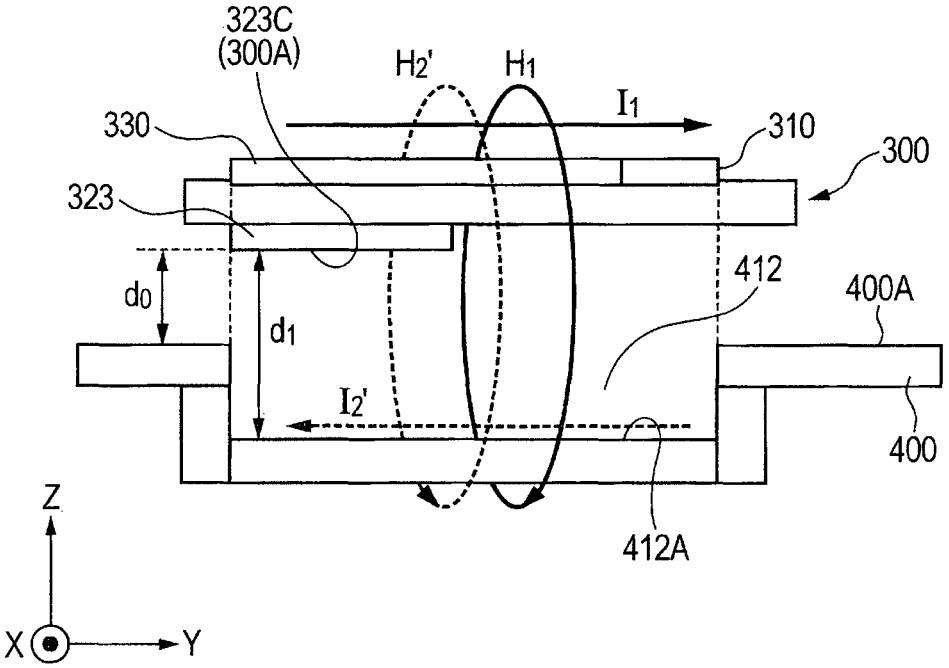
FIG. 12 is a schematic diagram illustrating the situation of the magnetic field between a signal line of the antenna and the metal member in the wireless communication device according to the second embodiment of the present invention.

FIG. 12 is a schematic diagram illustrating the situation of the magnetic field between the antenna 300 and the metal member 400 around the end 320B of the ground conductor 320 in the wireless communication device according to the this embodiment. FIG. 12 illustrates a section (YZ plane) in the X direction.

In the wireless communication device 202 of this embodiment, the concave 412 is provided to reduce the amount of intersection of the magnetic field $H_1$ that intersects with the metal member 400, thereby suppressing occurrence of a cancellation magnetic field $H_2'$. Consequently, in Expression (1), the mutual inductance M can be configured to be small, and the entire inductance L can be configured to be large.

Here, the concave 412 has a bottom surface 412A on the side facing the ground conductor 320. The ground conductor 320 (the ground pattern 323 in this embodiment) has the surface 323C on the side facing the metal member 400.

The gap in the Z direction between the bottom surface 412A of the concave 412 and the surface 323C of the ground conductor 320, that is, the gap in the Z direction between the bottom surface 412A of the concave 412 and the surface 300A of the antenna 300 is defined as $d_1$. The gap in the Z direction between the portion on the surface 400A of the metal member 400 other than the concave 412 and the surface 323C of the ground conductor 320, that is, the distance in the Z direction between the portion on the surface 400A of the metal member 400 other than the concave 412 and the surface 300A of the antenna 300 is defined as $d_0$.

At this time, the capacitance C becomes low because of the arrangement of the concave 412. However, in proximity to the signal line 330, the electric field intensity is relatively lower than the electric field intensity at another position. That is, the (E/H) ratio is small. Consequently, even if the gap to the ground conductor 320 at the concave 412 is large, the amount of reduction in capacitance C is small. Therefore, L×C increases while the resonant frequency $f_0$ becomes low.

Thus, increase in inductance L can reduce the resonant frequency $f_0=1/(2\times\pi\times\sqrt{(L\times C)})$. The resonant frequency $f_0$ illustrated in FIG. 27 can be moved down to the communication frequency $f_1$, and the radiation efficiency $\eta$ can be increased to be higher than $\eta_a$. As described above, due to the concave 412, when the signal waves are transmitted by the IC 105 through the antenna 300, the radiant quantity of radio waves at the communication frequency can be increased without increasing the power to be supplied to the IC 105. When the IC 105 receives signal waves through the antenna 300, the amount of reception of the signal waves at the communication frequency can be increased, which can negate the need to increase the amplification degree of the received signal, and can reduce the power consumption of the wireless communication device 202. Thus, the magnetic coupling between the antenna 300 and the metal member 400 is weakened at a place where the ratio of the electric field intensity to the magnetic field intensity of the antenna 300 is low. The resonant frequency $f_0$ between the antenna 300 and the metal member 400 is shifted to the communication frequency $f_1$. Consequently, the transmission and reception gains (communication gain, i.e., communication characteristics) at the communication frequency $f_1$ are improved.

That is, increase in the value (inductance L×capacitance C) between the metal plate 401 and the ground conductor 320 can reduce the resonant frequency $f_0$. In the region R2 where the magnetic field intensity is high, the inductance L is dominant. Consequently, the inductance L in the region R2 is configured to be high in the second embodiment.

Example 2

As Example 2, a result of execution of a three-dimensional electromagnetic simulation for the wireless communication device 202 illustrated in FIG. 9 is described. The calculation was performed using the three-dimensional electromagnetic simulator MW-STUDIO by CST. The antenna 300 was represented as a simulation model formed of a four-layer printed wiring board.

Figure 13A:
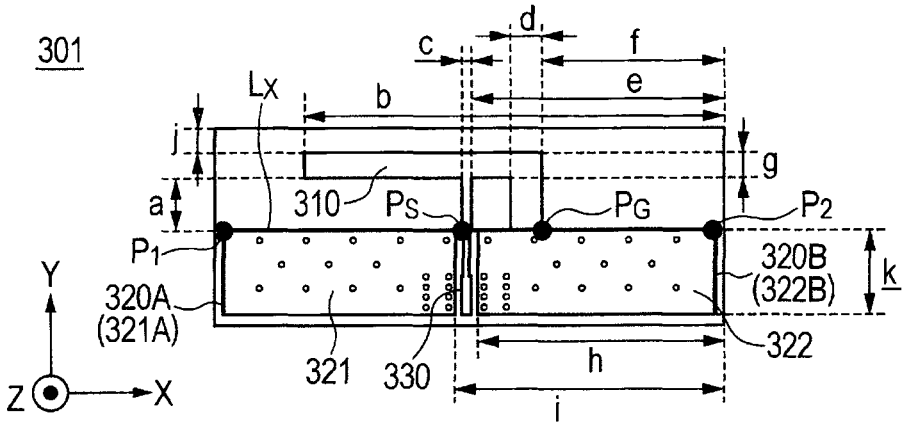
FIG. 13A is a plan view illustrating a simulation model of the first conductive layer of Example 2.
Figure 13B:
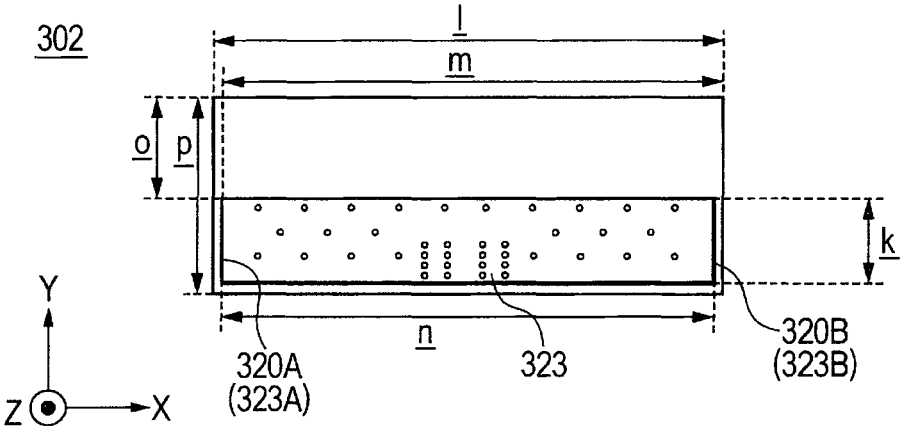
FIG. 13B is a plan view illustrating a simulation model of the second, third and fourth conductive layers of Example 2.
Figure 13C:
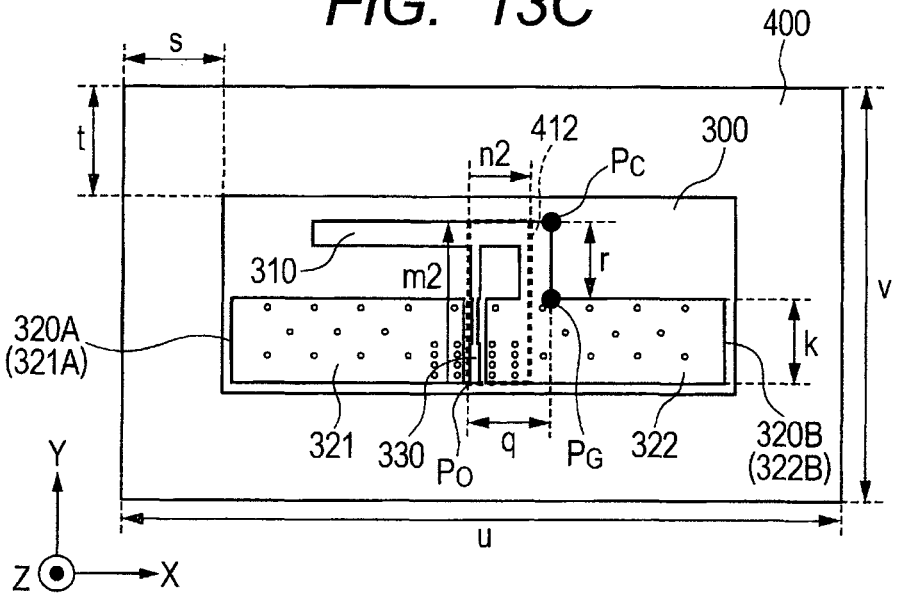
FIG. 13C is a plan view illustrating the positional relationship of a simulation model of the antenna and the metal member of Example 2.

FIG. 13A is a plan view illustrating a simulation model of the first conductive layer of the antenna 300. FIG. 13B is a plan view illustrating a simulation model of the second, third and fourth conductive layers of the antenna 300. FIG. 13C is a plan view illustrating the positional relationship of a simulation model of the antenna 300 and the metal member 400.

The gap $d_0$ (FIG. 12) between the surface 300A of the antenna 300 and the surface 400A (the portion other than the concave) of the metal member 400 was configured as 1.0 [mm]. The other dimensions are the same as those in FIGS. 6A, 6B and 6C in Example 1. The dimension values of elements illustrated in FIG. 13A are aa=5.3 [mm], b=41.8 [mm], c=0.9 [mm], d=3.0 [mm], e=25.0 [mm], f=18.0 [mm], g=2.5 [mm], and h=24.4 [mm]. Furthermore, i=26.5 [mm], j=2.4 [mm], and k=8.5 [mm]. The dimension values of elements illustrated in FIG. 13B are l=50.9 [mm], m=50.0 [mm], n=49.1 [mm], o=10.2 [mm], and p=19.8 [mm]. The dimension values of elements illustrated in FIG. 13C are q=7.9 [mm], r=7.8 [mm], s=15.0 [mm], t=15.0 [mm], u=80.9 [mm], and v=49.8 [mm].

Figure 14A:
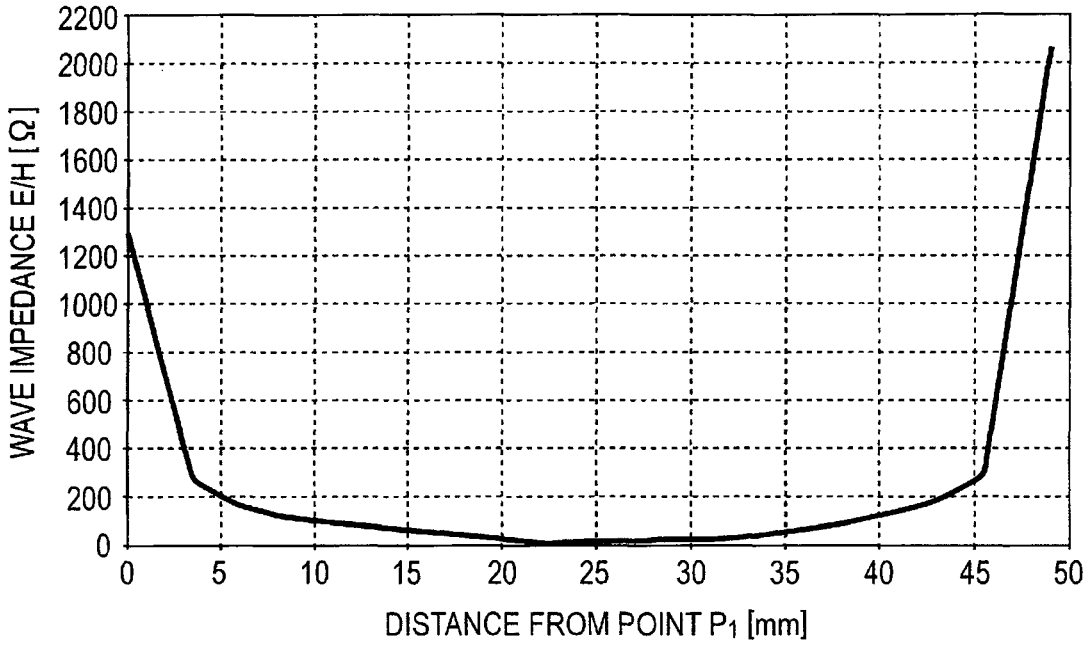
FIG. 14A is a graph illustrating the value of wave impedance in Example 2.
Figure 14B:
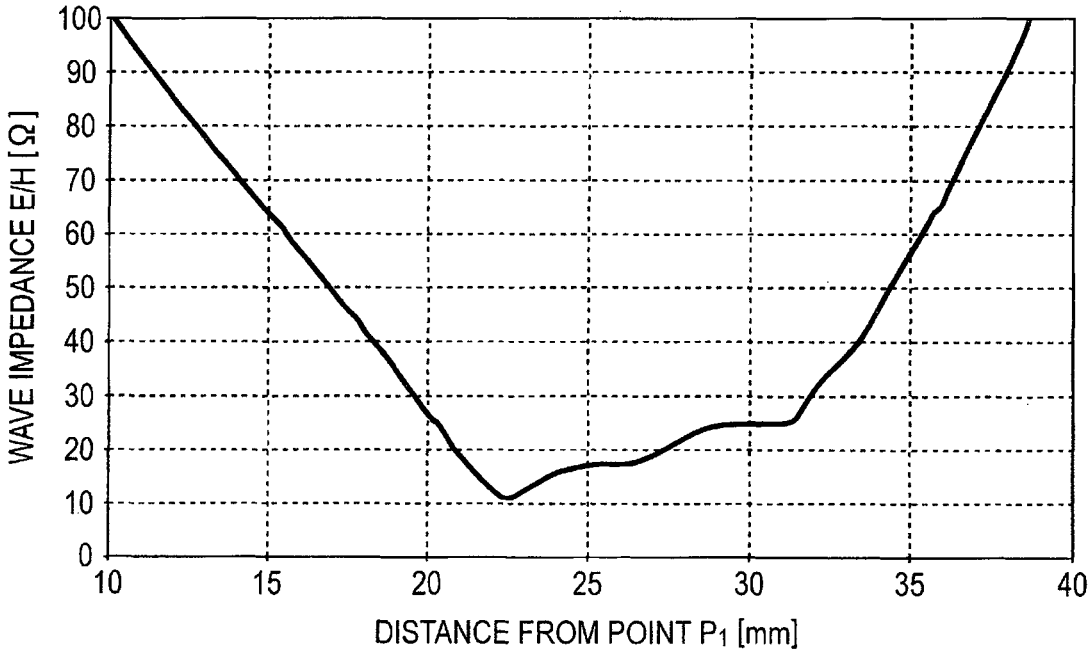
FIG. 14B is an enlarged graph of a range where the wave impedance has a value of 100 [Ω] or less in FIG. 14A.

FIG. 14A is a graph illustrating a simulation result, and a graph illustrating the value of wave impedance with respect to the distance from the point $P_1$ to the point $P_2$ in the +X direction on the solid line $L_X$ in the X direction connecting the point $P_1$ and the point $P_2$ in FIG. 13A. FIG. 14B is an enlarged graph of a range where the wave impedance is 100 [Ω] or less in FIG. 14A.

As illustrated in FIGS. 14A and 14B, as the distance from the point $P_1$ increases, the wave impedance decreases. At the position with the distance of 23 [mm], i.e., the point $P_S$ (FIG. 13A), the minimum value of 11 [Ω] is achieved. After this point $P_S$ is exceeded in the +X direction, the wave impedance gradually increases. At the position with the distance of 32 [mm], i.e., around the point $P_G$, the wave impedance begins to rapidly increase. That is, a point where the wave impedance (E/H) of the antenna 300 is the minimum value is the signal line 330.

Consequently, the concave 412 is formed at a position overlapping with at least the part of the signal line 330, desirably the entire signal line 330, as viewed in the −Z direction.

The concave 412 can be entirely overlaid on the signal line 330 as viewed in the −Z direction. However, the configuration is not limited thereto. Alternatively the concave 412 may slightly deviate from the signal line 330. That is, the range of the arrangement position of the concave 412 with respect to the signal line 330 is a range with a wave impedance (E/H) of 25 [Ω] or less; this value is that at the point $P_G$ with the distance 32 [mm] where the wave impedance (E/H) begins to rapidly increase. That is, the range of the wave impedance E/H where the concave 412 and the signal line 330 is required to at least partially overlap with each other is represented by the following Expression (10).

$$11[\Omega] \leq \frac{E}{H} \leq 20[\Omega] \qquad \text{Expression (10)}$$

The wave impedance at the signal line 330 is regarded as $\eta_{MIN}$, and Expression (10) is normalized, and the following Expression (11) is obtained.

$$\eta_{MIN} \leq \frac{E}{H} \leq 1.8 \cdot \eta_{MIN} \qquad \text{Expression (11)}$$

That is, the concave 412 is formed at the position of at least partially overlapping the region of the antenna 300 where the ratio (E/H) of the electric field intensity E to the magnetic field intensity H is 1.0 or more times and 1.8 or less times as high as the minimum value $\eta_{MIN}$ as viewed in the −Z direction. Furthermore, the concave 412 can be formed at a position overlaid on the entire region of the minimum value $\eta_{MIN}$ as viewed in the −Z direction. The radiant quantity of radio waves at the communication frequency $f_1$ can thus be effectively improved.

Next, in the wireless communication device 202 of Example 2, the shape of the concave 412 that can improve the radiant quantity of radio waves at the communication frequency $f_1$ is described. The wireless communication device of the comparative example illustrated in FIG. 25 was also modeled as with the Example 2. The difference from the simulation model in Example 2 is only in that the concave 412 is not included in FIG. 13A. The dimensions of other elements were configured to be analogous. As to each of the models of Example 2 and the comparative example, the power to be supplied to the antenna 300 was configured to be 100 [mW], and the communication frequency was configured to be 2.45 [GHz], and the entire radiant power [mW] emitted from the antenna 300 was obtained.

Figure 15A:
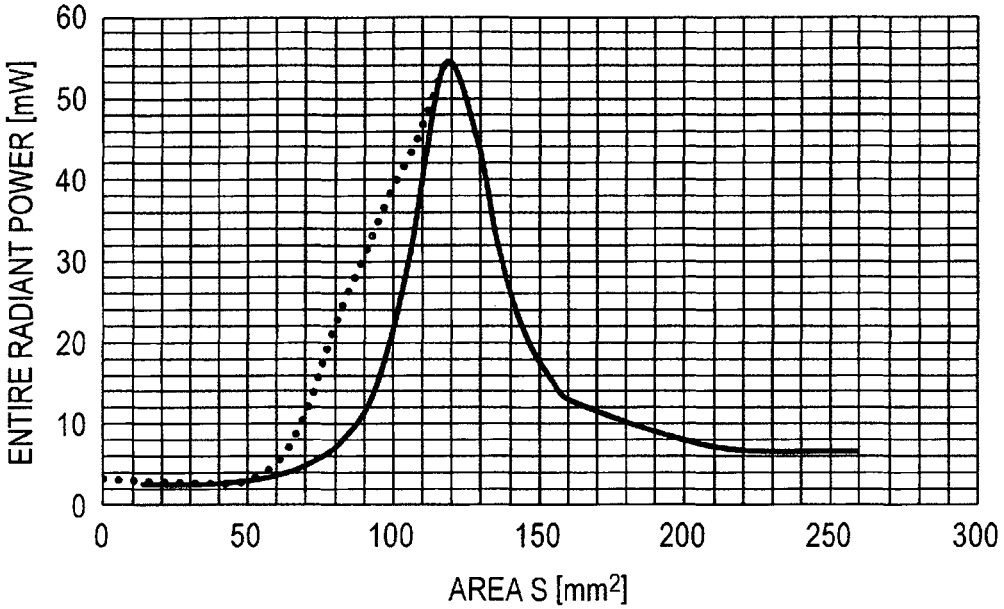
FIG. 15A is a graph illustrating the entire radiant power of the antenna with respect to an area S in Example 2.

FIG. 15A is a graph illustrating the entire radiant power of the antenna 300 with respect to the area S of an overlapping portion between the concave 412 and the antenna 300 as viewed in −Z direction. The gap $d_1$ between the surface 300A of the antenna 300 and the bottom surface 412A of the concave 412 (FIG. 12) was fixed to 2.5 [mm]. In FIG. 13C, the value of the entire radiant power [mW] in the case where the area S of the overlapping portion between the concave 412 and the antenna 300 as viewed in the −Z direction was changed was observed.

In FIG. 15A, the solid line represents the characteristics (simulation result) in the case where the longitudinal length m2 of the concave 412 in FIG. 13C is fixed to 16.3 [mm]

(=the sum of the dimension r and the dimension k) while changing the lateral direction n2. In FIG. 15A, the broken line represents the characteristics (simulation result) in the case where the lateral length n2 of the concave 412 in FIG. 13C is fixed to 7.2 [mm] while changing the longitudinal direction m2 to the point $P_C$.

The entire radiant power in the case where the concave 412 has an area S=0 is a calculation result of the comparative example, and has a value of 3.2 [mW]. In Example 2, the range having an advantageous effect at least twice higher than the entire radiant power of 3.2 [mW] of the comparative example is a range of 78 [$mm^2$]≤S≤220 [$mm^2$] indicated by the solid line and S≥62 [$mm^2$] indicated by the broken line.

The range in which both the ranges overlap and which has an advantageous effect at least twice higher than that of the comparative example is 78 [$mm^2$]≤S≤220 [$mm^2$].

As viewed in the −Z direction, an endpoint of the one end 330A of the signal line 330 on a side close to the end 320A is $P_O$, and the apex at an external corner at the bent portion 310C of the antenna element 310 is $P_C$. As viewed in the −Z direction, the area of the region (region of (r+k)×q) of a rectangular whose diagonal points $P_O$ and $P_C$ is defined as $S_0$ [$mm^2$].

The range of 78 [$mm^2$]≤S≤220 [$mm^2$] is normalized with the area $S_0$ [$mm^2$] (=(r+k)×q=129 [$mm^2$]) to obtain the range of Expression (12).

$$0.6 \cdot S_0 \leq S \leq 1.7 \cdot S_0 \quad \text{Expression (12)}$$

That is, as viewed in the −Z direction, the area S can be in a range 0.6 or more times and 1.7 or less times as large as the area $S_0$ of the rectangular region.

The range having a specifically highly advantageous effect, which is at least 10 times higher than that of the comparative example, is a range defined by the solid line 106 [$mm^2$]≤S≤136 [$mm^2$] and the broken line S≥92 [$mm^2$] in FIG. 15A. The range in which both the ranges overlap and which has an advantageous effect at least 10 time higher than that of the comparative example is 106 [$mm^2$]≤S≤136 [$mm^2$]. Likewise, the range is normalized with the area $S_0$ to obtain the range of Expression (13).

$$0.8 \cdot S_0 \leq S \leq 1.1 \cdot S_0 \quad \text{Expression (13)}$$

That is, as viewed in the −Z direction, the area S can be in a range 0.8 or more times and 1.1 or less times as large as the area $S_0$ of the rectangular region.

Figure 15B:
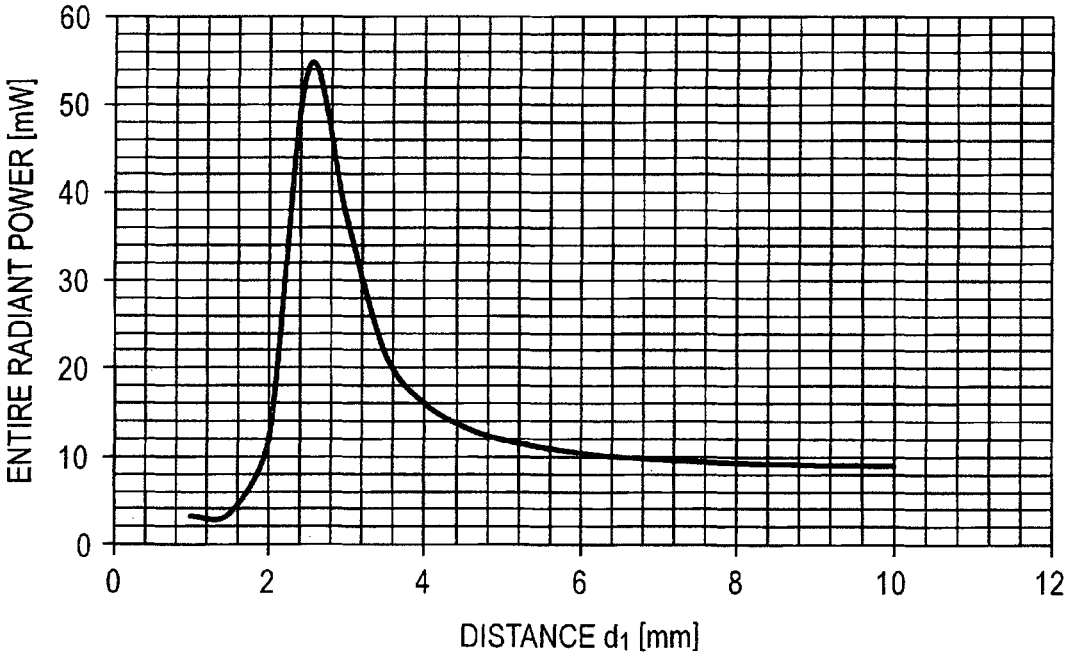
FIG. 15B is a graph illustrating the entire radiant power of the antenna with respect to a gap $d_1$ in Example 2.

FIG. 15B is a graph illustrating the entire radiant power of the antenna 300 with respect to the gap $d_1$ in the case where the gap $d_0$ is fixed and the gap $d_1$ is changed in Example 2. In the simulation result of FIG. 15B, the entire radiant power [mW] is observed when the gap $d_0$ [mm] is fixed to 1.0 [mm] and the gap $d_1$ [mm] between the antenna 300 and the concave 412 is changed in the −Z direction. The graph illustrated in FIG. 15B represents the characteristics under the condition where the most advantageous effect is achieved in FIG. 15A and m2=16.3 [mm] and n2=7.2 [mm] (area S=117 [$mm^2$]) are fixed while changing the gap $d_1$ in FIG. 13C.

Here, the entire radiant power in the case where gap $d_1$=1.0 [mm] is the calculation result of the comparative example. The value is 3.2 [mW]. In Example 2, the range having an advantageous effect at least twice higher than the entire radiant power of 3.2 [mW] of the comparative example is a range of 1.8 [mm] $d_1$ [mm]. This range is normalized with the gap $d_0$ [mm] (=1.0 [mm]) between the ground pattern 323 and the surface 400A of the metal member 400 in FIG. 12 to obtain the following Expression (14).

$$d_1 \geq 1.8 \cdot d_0 \quad \text{Expression (14)}$$

That is, the gap $d_1$ can be in a range 1.8 or more times as high as the gap $d_0$.

The range having a specifically highly advantageous effect, which is at least 10 times higher than that of the comparative example, is 2.2 [mm]≤$d_1$≤3.1 [mm]. Likewise, the range is normalized with the gap $d_0$ to obtain the range of Expression (15).

$$2.2 \cdot d_0 \leq d_1 \leq 3.1 \cdot d_0 \quad \text{Expression (15)}$$

That is, the gap $d_1$ can be in a range 2.2 or more times and 3.1 or less times as high as the gap $d_0$.

The present invention is not limited by the embodiment described above. Instead, various modifications can be made within the technical thought of the present invention. The advantageous effects described in the embodiments of the present invention can be only a list of advantageous effects exerted by the present invention. The advantageous effects by the present invention are not limited by the description in the embodiments of the present invention.

In the second embodiment, the shape of the concave 412 (bottom surface 412A) is described according to the case of having a rectangular shape as viewed in the −Z direction. However, the configuration is not limited thereto. Any of shapes, such as circular and polygonal shapes as viewed in the −Z direction, may be adopted.

In the second embodiment, the description has been made for the case where the concave 412 is formed on the surface 400A of the metal member 400. However, the configuration is not limited thereto. It is only required that the gap in the Z direction between the region R2 on the surface 300A of the antenna 300 and the surface 400A of the metal member 400 is larger than the gap in the Z direction between the region R3 on the surface 300A of the antenna 300 and the surface 400A of the metal member 400. For example, a step or a surface inclined from the surface 300A of the antenna 300 may be provided on the surface 400A of the metal member 400.

In the second embodiment, the description has been made for the case of application where the antenna 300 is the inverted-F antenna. Alternatively, as long as the antenna 300 is a patterned antenna having a ground pattern arranged on the same plane as or a plane parallel to that of the antenna element, the present invention is applicable.

In the second embodiment, the description has been made for the case where the electronic apparatus is an X-ray image diagnostic apparatus, which is an example of an imaging apparatus. However, the configuration is not limited thereto. For example, the imaging apparatus may be any of a digital camera and a smartphone. The present invention is applicable to any electronic apparatus other than the imaging apparatus.

According to the second embodiment of the present invention, the antenna and the metal member get away from each other at a position where the ratio of the electric field intensity to the magnetic field intensity is low, which can prevent the cancellation magnetic field from occurring. Consequently, the resonant frequency of the antenna and the metal member is shifted toward the communication frequency, and the transmission and reception gains at the communication frequency can be improved.

Third Embodiment

Figure 16:
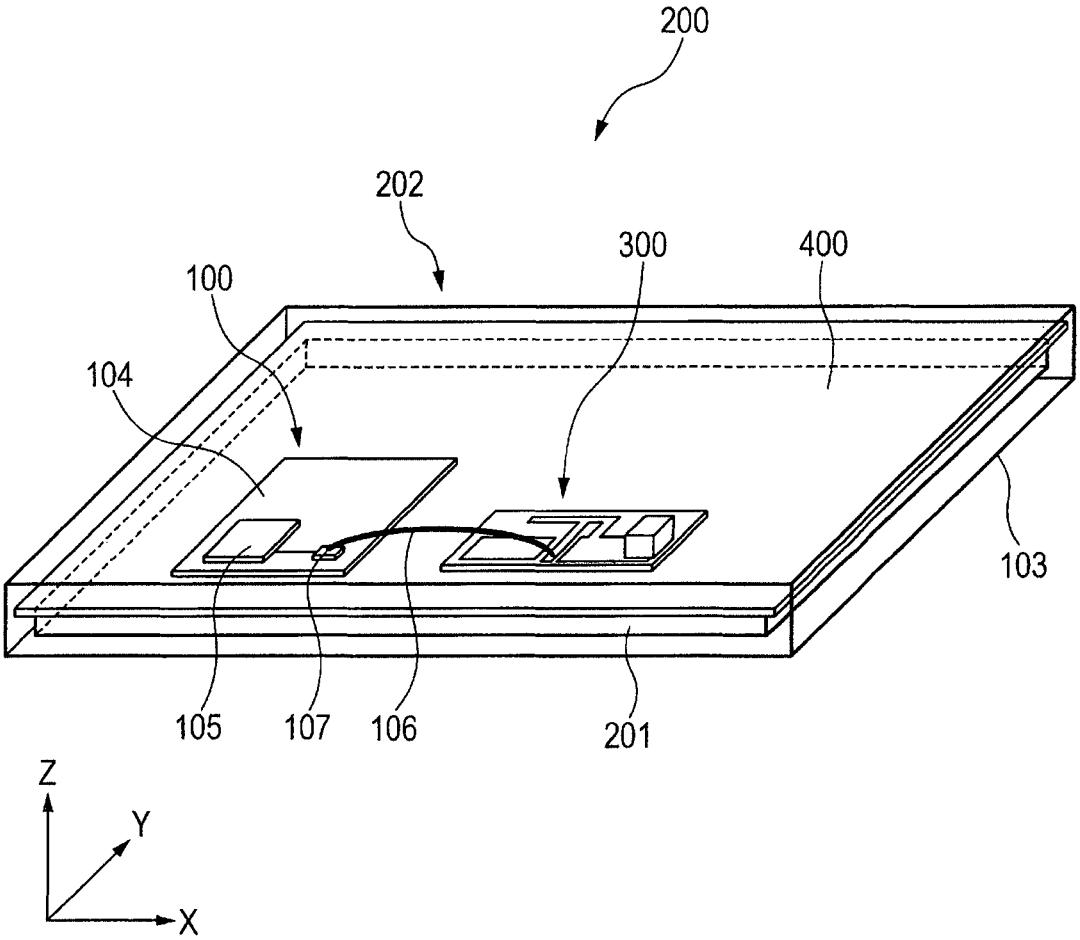
FIG. 16 is a diagram illustrating an X-ray image diagnostic apparatus, which is an example of an electronic apparatus including a wireless communication device according to a third embodiment of the present invention.

Hereinafter, a third embodiment of the present invention is described in detail with reference to FIGS. 16 to 31. The same members as those of FIGS. 1 to 8B illustrating the first embodiment are assigned the same symbols. The description thereof is omitted. FIG. 16 is a diagram illustrating an X-ray image diagnostic apparatus, which is an example of an electronic apparatus including a wireless communication device according to a third embodiment of the present invention. Here, the X, Y and Z directions illustrated in FIG. 16 are directions orthogonal to (intersecting with) each other.

In FIG. 16, the IC 105 processes the received image signal, and wirelessly transmits signal waves modulated to have a frequency in the communication frequency band (e.g., 2.4 [GHz] band or 5 [GHz] band) via the antenna 300. The antenna 300 may be any one that can efficiently emit electromagnetic waves at a communication frequency. In this embodiment, the antenna is an inverted-F antenna.

The antenna 300 includes an antenna element 310, a ground conductor 320, a signal line 330, and a conductor piece 350. The antenna element 310, the ground conductor 320, the signal line 330 and the conductor piece 350 are made of conductors (metal components). The ground conductor 320 is used as a ground of the antenna element 310. The conductor piece 350 faces a predetermined region R on the ground conductor 320 so as to cover the region R. More specifically, the conductor piece 350 is attached to the region R with a connection member 351 made of a dielectric substance (e.g., adhesive) or a conductive substance (e.g., solder). In this embodiment, the connection member 351 is made of a dielectric substance, such as an adhesive. The conductor piece 350 is formed to have a rectangular parallelepiped shape. The region R is a region on the surface of the ground conductor 320.

Figure 17A:
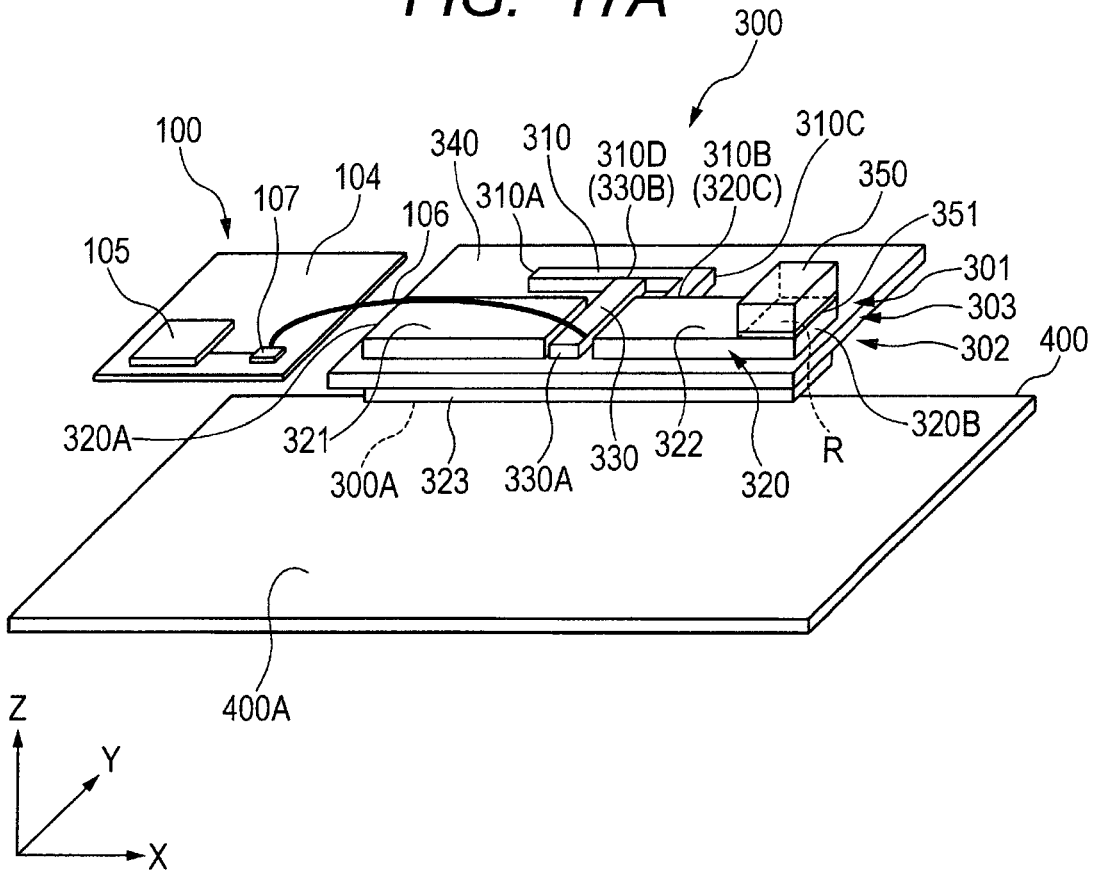
FIG. 17A is an exploded perspective view for illustrating the arrangement relationship between a printed circuit board, an antenna, and a metal member of the wireless communication device according to the third embodiment of the present invention.
Figure 17B:
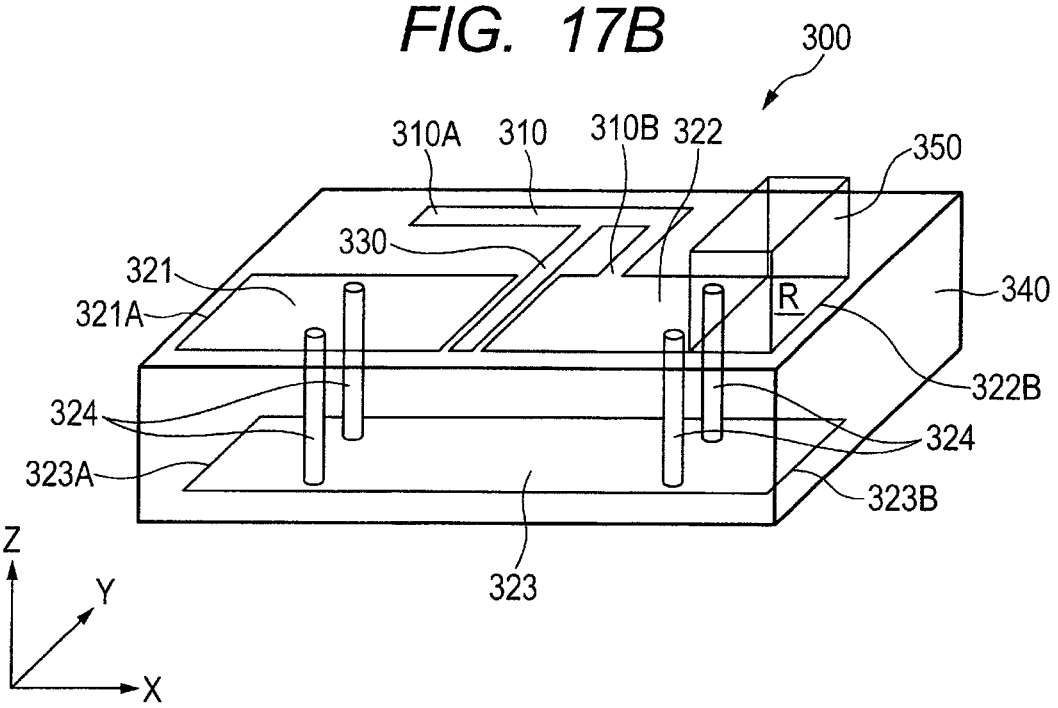
FIG. 17B is a perspective view illustrating a connection state of a conductor of the antenna of the wireless communication device according to the third embodiment of the present invention.

FIG. 17B is a perspective view illustrating the connection state of the conductor of the antenna 300. As illustrated in FIGS. 17A and 17B, the ground conductor 320 includes a ground pattern 321 that is formed on a conductive layer 301 and serves as a first ground pattern, and a ground pattern 322 that is formed on the conductive layer 301 and serves as a second ground pattern. The ground conductor 320 includes a ground pattern 323 that is formed on a conductive layer 302 and serves as a third ground pattern. As illustrated in FIG. 17B, the ground conductor 320 has a plurality of vias 324 that connects the ground patterns 321 and 322 and the ground pattern 323 to each other. Consequently, the ground pattern 323 is conducted with the ground patterns 321 and 322 through the vias 324. The ground patterns 321 and 322 are arranged on both sides in the X direction (second direction) intersecting with (orthogonal to) the wiring direction (Y direction: first direction) of the signal line 330. The ground patterns 321 and 322 are formed to have external quadrangular shapes (more specifically, external rectangular shapes) as viewed in the −Z direction. The ground pattern 323 is formed to have external quadrangular shapes (more specifically, external rectangular shapes) including the ground patterns 321 and 322 as viewed in the −Z direction.

In recent years, according to reduction in size of the electronic apparatus, the ground pattern is often designed to have a small area. Also in this embodiment, to achieve reduction in size of the antenna 300, the ground patterns 321, 322 and 323 are designed to have small areas as much as possible. The description is thus made for the case where the length ($\lambda/2$) in the longitudinal direction (X direction) of the ground conductor 320 (ground pattern 323) is ½ of the wavelength $\lambda$ of the communication frequency or less ($\lambda'<\lambda$).

In FIG. 17A, the ground pattern 321 and the ground pattern 322 seem as if the patterns are separated by the signal line 330. However, as illustrated in FIG. 17B, the patterns are conducted by the vias 324 and the ground pattern 323.

In this embodiment, the conductor piece 350 is arranged in the region R including the end 320B of the ground conductor 320, i.e., the end 322B of the ground pattern 322. That is, the conductor piece 350 is arranged in the region R including the end 322B on the surface of the ground pattern 322. The conductor piece 350 is provided to project on the side opposite to the side of the metal member 400 with respect to the ground conductor 320. In this embodiment, the description is made for the case where the conductor piece 350 is arranged at the ground pattern 322. Alternatively, the conductor piece may be arranged in a region including the end 322B of the ground pattern 323 on the side facing the metal member 400.

Figure 29A:
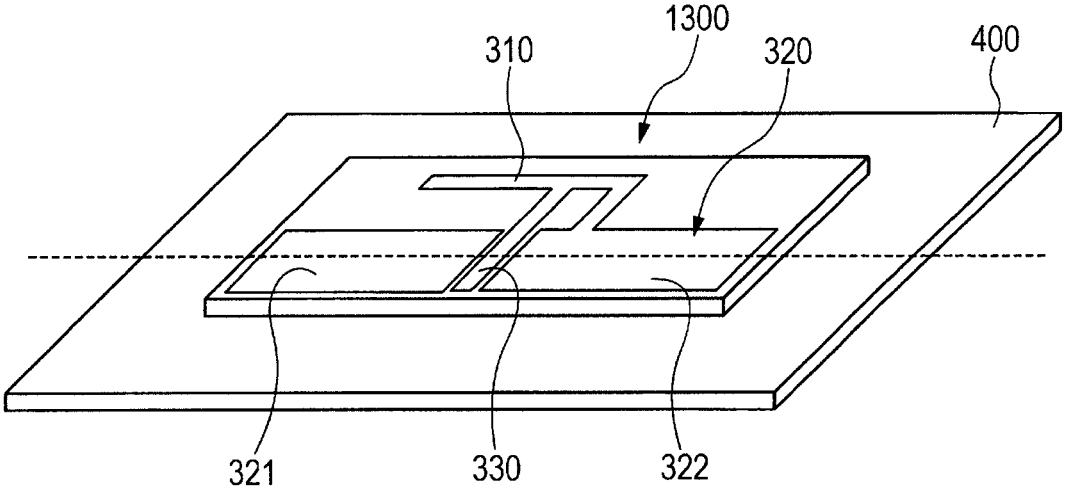
FIG. 29A is a perspective view illustrating a case where the metal member is arranged in proximity to an inverted-F antenna of a comparative example.

Here, FIG. 29A is a perspective view illustrating a case where the metal member 400 is arranged in proximity to an inverted-F antenna 1300 of a comparative example. The inverted-F antenna 1300 is an antenna in a state without the conductor piece 350 in FIGS. 17A and 17B.

Figure 29B:
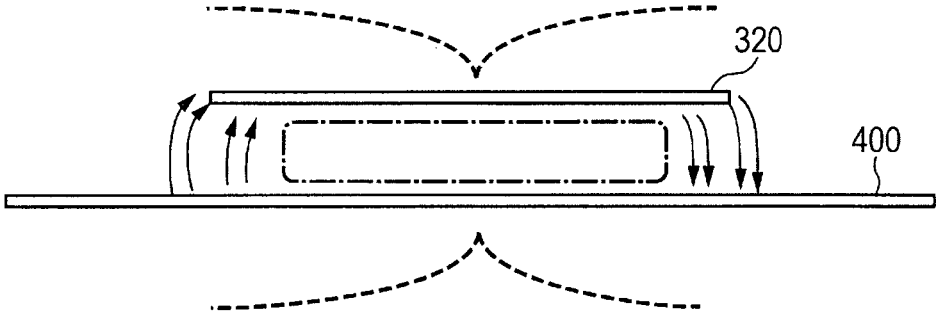
FIG. 29B is a schematic diagram illustrating an electric field formed at both of the ground conductor and the metal member in the comparative example.

FIG. 29B is a schematic diagram illustrating an electric field formed at both of the ground conductor 320 and the metal member 400 on a section along broken lines in FIG. 29A. In FIG. 29B, the ground conductor 320 is schematically represented as a single metal plate. In the case of arranging the metal member 400 close to the inverted-F antenna 1300, capacitive coupling due to electric lines of force as illustrated by solid lines in FIG. 29B occurs between the opposite ends of the ground conductor 320 and the metal member 400.

Figure 29C:
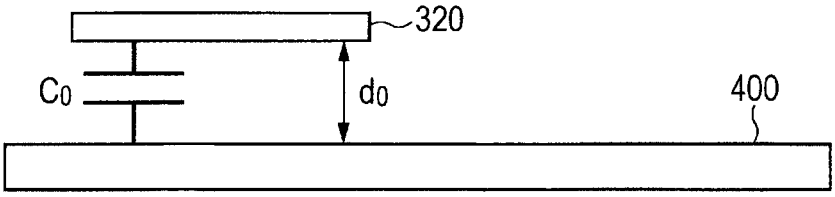
FIG. 29C is a schematic diagram illustrating a capacitive coupling state between the ground conductor and the metal member in the comparative example.

FIG. 29C is a schematic diagram illustrating a capacitive coupling state between the ground conductor 320 and the metal member 400. In FIG. 29C, the ground conductor 320 and the metal member 400 are capacitively coupled with a capacitance $C_0$. This capacitive coupling causes a resonance phenomenon at a certain frequency. In FIG. 29B, as illustrated by broken lines, the electric field is weak at the center of the ground conductor 320 and strong at both the ends, and functions as a loop-shaped antenna indicated by an alternate long and short dashed line in FIG. 29B. This loop-shaped path length resonates at a frequency where the path length around the loop is the wavelength $\lambda'$.

In the case where the length ($\lambda'/2$) between the ends of the ground conductor 320 is less than ½ of the wavelength $\lambda$ of the communication frequency ($\lambda'<\lambda$), the resonance phenomenon between the inverted-F antenna 1300 and the metal member 400 occurs at a higher frequency $f_2$ than the resonant frequency $f_1$ of the inverted-F antenna 1300.

Figure 30A:
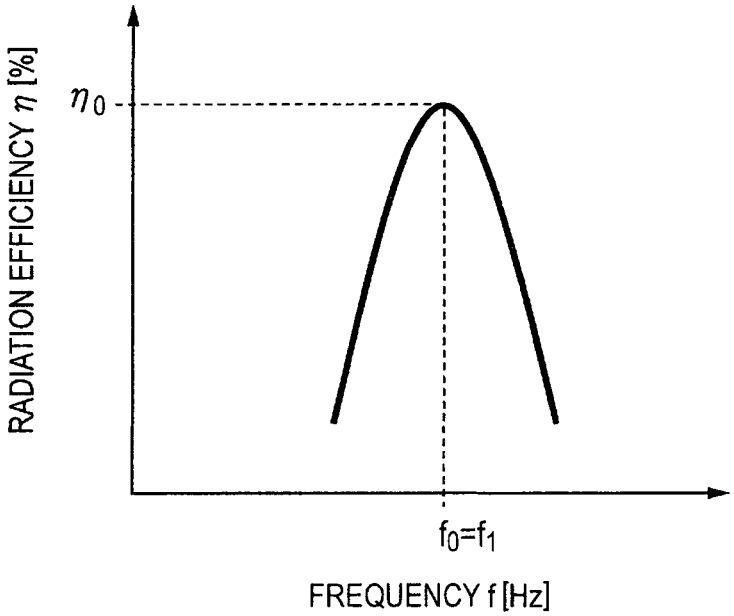
FIG. 30A is a diagram illustrating the frequency characteristics of the radiation efficiency of the antenna in the case where the metal member is not arranged in proximity to the antenna in the comparative example.

FIG. 30A is a diagram illustrating the frequency characteristics of the antenna 1300 in the case where the metal member 400 is not arranged in proximity to the antenna 1300 in the comparative example. As illustrated in FIG. 30A, the antenna 1300 resonates at the frequency $f_1$ with respect to the communication frequency $f_0$.

Figure 30B:
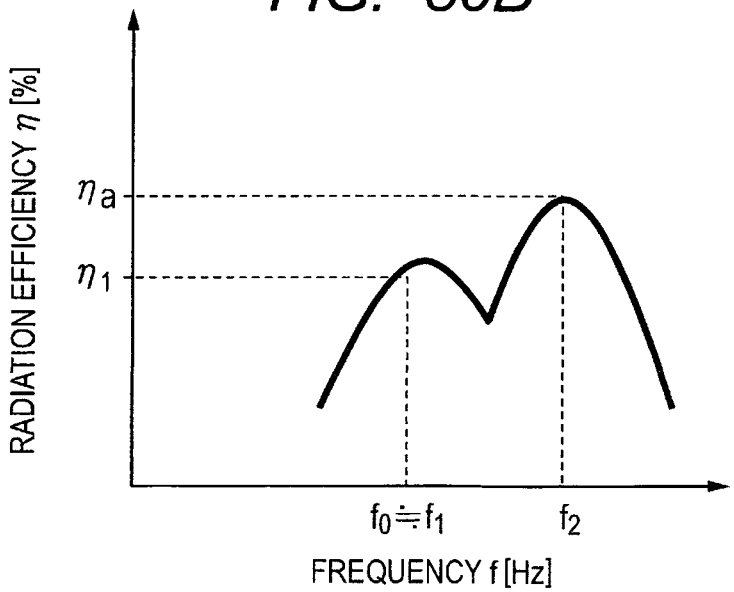
FIG. 30B is a diagram illustrating the frequency characteristics of the radiation efficiency of the antenna in the case where the metal member is arranged in proximity to the antenna in the comparative example.

FIG. 30B is a diagram illustrating the frequency characteristics of the radiation efficiency of the antenna 1300 in the case where the metal member 400 is arranged in proximity to the antenna 1300 in the comparative example. As illustrated in FIG. 30B, the capacitance $C_0$ due to the capacitive coupling between the ground conductor 320 and the metal member 400 causes a resonance phenomenon between the inverted-F antenna 1300 and the metal member 400 at the higher frequency $f_2$ than the resonant frequency $f_1$ of the inverted-F antenna 1300.

This resonance phenomenon disperses the energy, and reduces the radiation efficiency at the communication frequency $f_0$ from $\eta_0$ to $\eta_1$ ($\eta_0>\eta_1$). Consequently, the radiant quantity of radio waves of the antenna 1300 is reduced. The description has been made for the case where the signal waves are transmitted from the antenna 1300. The configuration is also applicable to the case where the signal waves are received from the antenna 1300. Also in this case, the amount of radio wave received by the antenna 1300 is reduced.

In this embodiment, the conductor piece 350 is provided for the ground conductor 320. Consequently, the resonant frequency $f_2$ caused by an arrangement where the metal member 400 is close to the antenna 300 is shifted to the communication frequency $f_0$.

Figure 18:
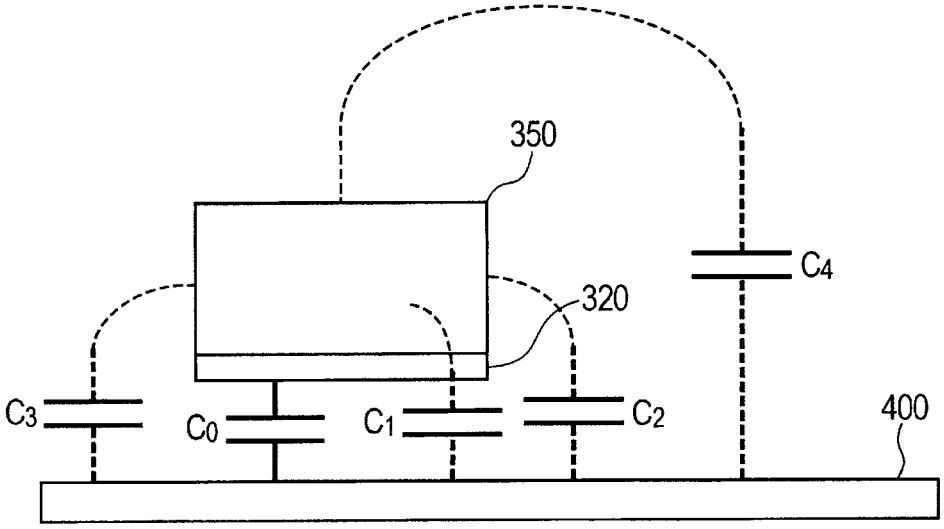
FIG. 18 is a schematic diagram illustrating the situation of the capacitive coupling between a ground conductor and a conductor piece of the antenna in the wireless communication device according to the third embodiment of the present invention.

FIG. 18 is a schematic diagram illustrating the situation of the capacitive coupling between a ground conductor of the antenna and a conductor piece in the wireless communication device according to this embodiment. As illustrated in FIG. 18, the conductor piece 350 is provided for the ground conductor 320, thereby capacitively coupling each surface of the conductor piece 350 and the metal member 400 with capacitances $C_1$, $C_2$, $C_3$ and $C_4$. As a result, due to the arrangement of the conductor piece 350, the combined capacitance C has a higher value than the capacitance $C_0$. According to calculation with the resonant frequency $f_2=1/(2\times\pi\times\sqrt{(L\times C)})$, the resonant frequency $f_2$ is shifted toward the low frequency $f_0$. In the case where each surface of the conductor piece 350 have the dimensions (area) so as to allow the communication frequency $f_0$ to coincide with the resonant frequency $f_2$, the radiation efficiency can be improved.

Next, the arrangement position of the conductor piece 350 is described. As illustrated in FIGS. 17A and 17B, the conductor piece 350 is arranged at the end 320B of the ground conductor 320 on the side opposite to the end 320A close to the one end 310A of the antenna element 310.

If the conductor piece 350 is arranged on the side of the end 320A, the resonant frequency $f_2$ of the antenna and the metal member 400 is shifted to a lower frequency. At the same time, the conductor piece 350 becomes closer to the antenna element 310, thereby also shifting the resonant frequency $f_1$ of the antenna to a lower frequency. As a result, the two resonant frequencies $f_1$ and $f_2$ are thus shifted. Consequently, a great effect of improving the radiation efficiency cannot be exerted.

The position suitable for arrangement of the conductor piece 350 is the end 320B, which is on the side opposite to the end 320A and does not affect the antenna element 310. In this embodiment, the conductor piece 350 is provided in the region R including the end 320B.

Figure 19A:
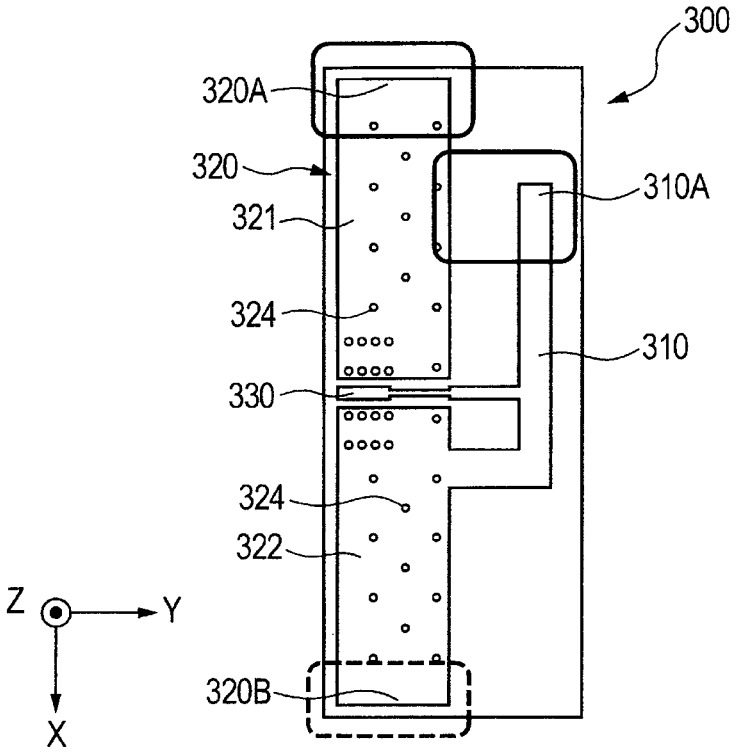
FIG. 19A is a schematic diagram illustrating an electric field distribution formed at the antenna.
Figure 19B:
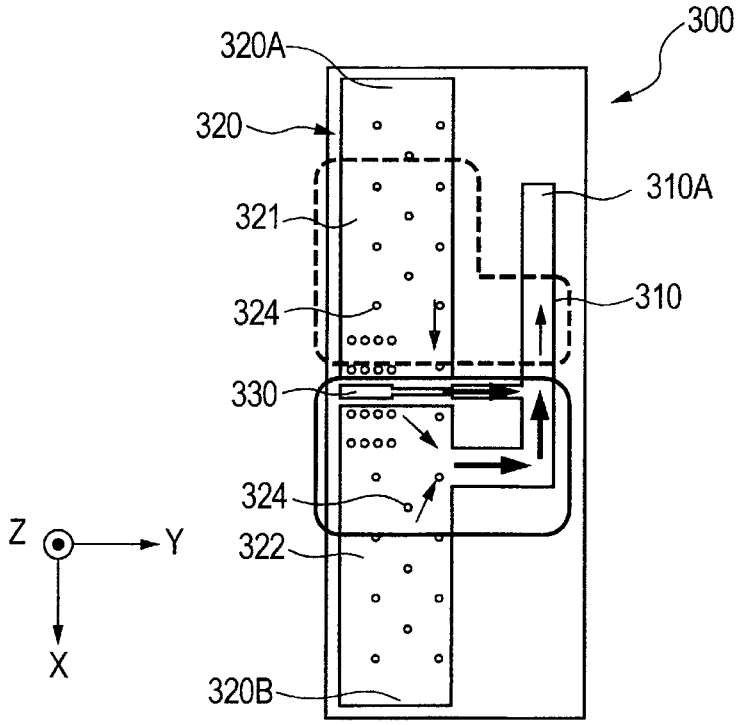
FIG. 19B is a schematic diagram illustrating a magnetic field distribution formed at the antenna.

Here, FIG. 19A is a schematic diagram illustrating an electric field distribution formed at the antenna, and FIG. 19B is a schematic diagram illustrating a magnetic field distribution formed at the antenna. In FIGS. 19A and 19B, solid lines indicate regions with any of highest electric fields or magnetic fields, and broken lines indicate the second highest electric field and magnetic field. In FIG. 19B, arrows indicate the flows of current. In FIGS. 19A and 19B, illustration of the conductor piece 350 is omitted.

Current supplied from the signal line 330 flows into the antenna element 310. At the one end 310A, which is the open end of the antenna element 310, the electric field is dominant, and coupled with the ground pattern 321 of the ground conductor 320. The ground pattern 321 is close to the one end 310A of the antenna element 310. Consequently, this pattern is coupled with the electric field at the one end 310A of the antenna element 310, and much return current flows through the ground pattern 321. At the end 320B of the ground conductor 320, the electric field is strong, and the current, i.e., the magnetic field, is weak with respect to that on the side of the end 320A. As a result, the end 320B of the ground conductor 320 is a site where the wave impedance is highest. Here, the wave impedance is the ratio (E/H) of the electric field intensity E to the magnetic field intensity H. The conductor piece 350 may be arranged at a site with the highest wave impedance E/H.

Consequently, in this embodiment, the conductor piece 350 is provided so as to cover the region R including the site where the wave impedance E/H on the surface of the ground conductor 320 is the maximum.

Here, the conductor piece 350 is a rectangular parallelepiped. One face of the rectangular parallelepiped has the same shape and area as those of the region R. That is, the region on the ground conductor 320 that the one face of the conductor piece 350 faces is the region R. Consequently, in the case where the conductor piece 350 is provided in the region R, the area (surface area) of the surface of the conductor piece 350 that is exposed to the outside is larger than the region R. Thus, the capacitance C becomes high. As a result, the resonant frequency $f_2$ is shifted toward the communication frequency $f_0$. Such arrangement of the conductor piece 350 can improve the radiation efficiency at the communication frequency $f_0$, and improve the radiant quantity of radio waves, i.e., communication characteristics, at the communication frequency $f_0$ without increasing the supply power (power consumption) from the IC 105. The case of causing the IC 105 to transmit the signal waves has been described. Likewise, also in the case of reception, the amount of reception of radio waves, i.e., the communication characteristics, can be improved. That is, the transmission and reception gains (communication gain) are improved. Thus, in the case where the X-ray image diagnostic apparatus 200 is driven by a battery, for example, much data transmission at one time charging can be achieved. Consequently, reduction in power during wireless communication can be facilitated.

That is, increase in the value (inductance L×capacitance C) between the metal plate 401 and the ground conductor 320 can reduce the resonant frequency $f_0$. In the region R where the electric field intensity is high, the capacitance C is dominant. Consequently, the capacitance C in the region R is configured to be high in the third embodiment similarly to the first embodiment.

Example 3

To indicate that the configuration of the third embodiment can improve the radiation efficiency based on the above principle, the following numerical simulation was performed, as an example. The communication frequency $f_0$ was set to 2.45 [GHz] to obtain the radiation efficiency [%]. The radiation efficiency was calculated as the ratio of the radiant power to the power supplied to the inverted-F antenna 300. The calculation was performed using the electromagnetic simulator MW-STUDIO by AET.

Figure 20A:
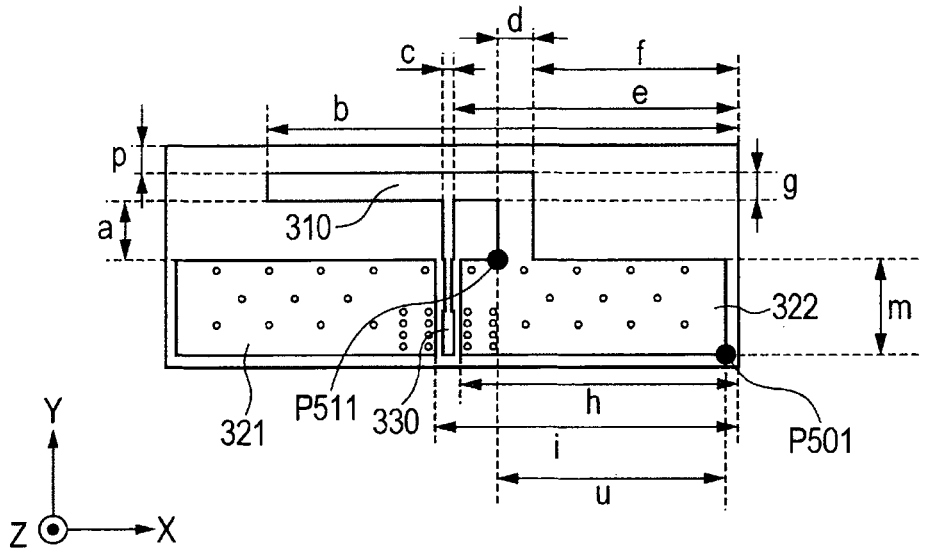
FIG. 20A is a diagram illustrating a calculation model of the first layer of the antenna formed of a printed wiring board of Example 3.
Figure 20B:
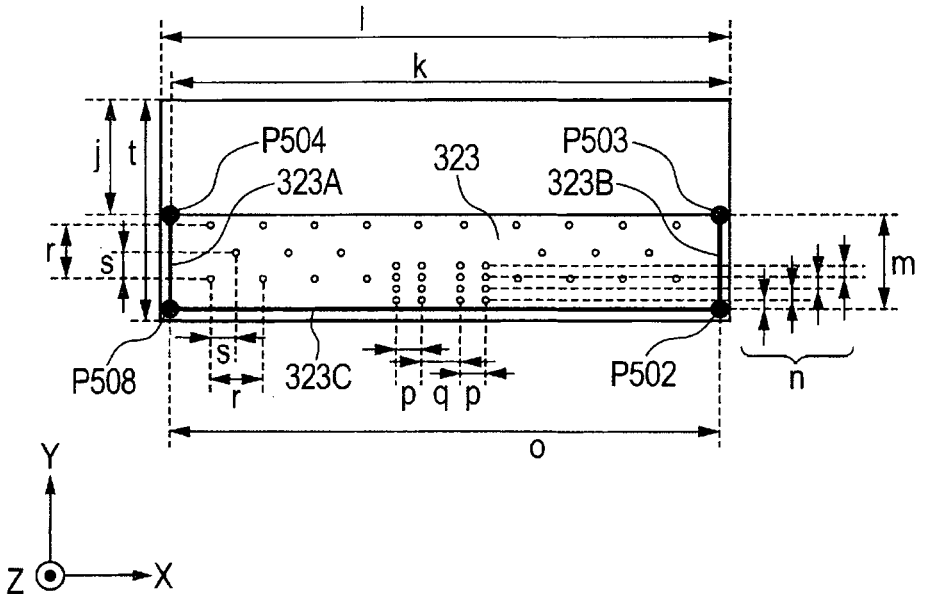
FIG. 20B is a diagram illustrating a calculation model of the second, third and fourth layers of the antenna formed of a printed wiring board of Example 3.

FIGS. 20A and 20B are diagrams illustrating calculation models of the antenna 300 formed of a printed wiring board having four conductive layers. FIG. 20A is a diagram illustrating a calculation model of the first layer of the antenna 300 formed of a printed wiring board. FIG. 20B is a diagram illustrating a calculation model of the second, third and fourth layers of the antenna 300 formed of a printed wiring board of Example 3. The ground patterns 321, 322 and 323 are connected by the vias 324. The thickness of wiring was 35 [μm]. The inter-layer distance between the first and second layers and that between the third and fourth layers were 0.2 [mm]. The inter-layer distance between the second and third layers was 0.875 [mm]. The thickness of the dielectric substance was 1.345 [mm]. The dielectric substance was made of FR4 (relative dielectric constant of 4.3). The wiring was made of copper (conductivity of $5.8\times10^7$ [S/m]).

Figure 21A:
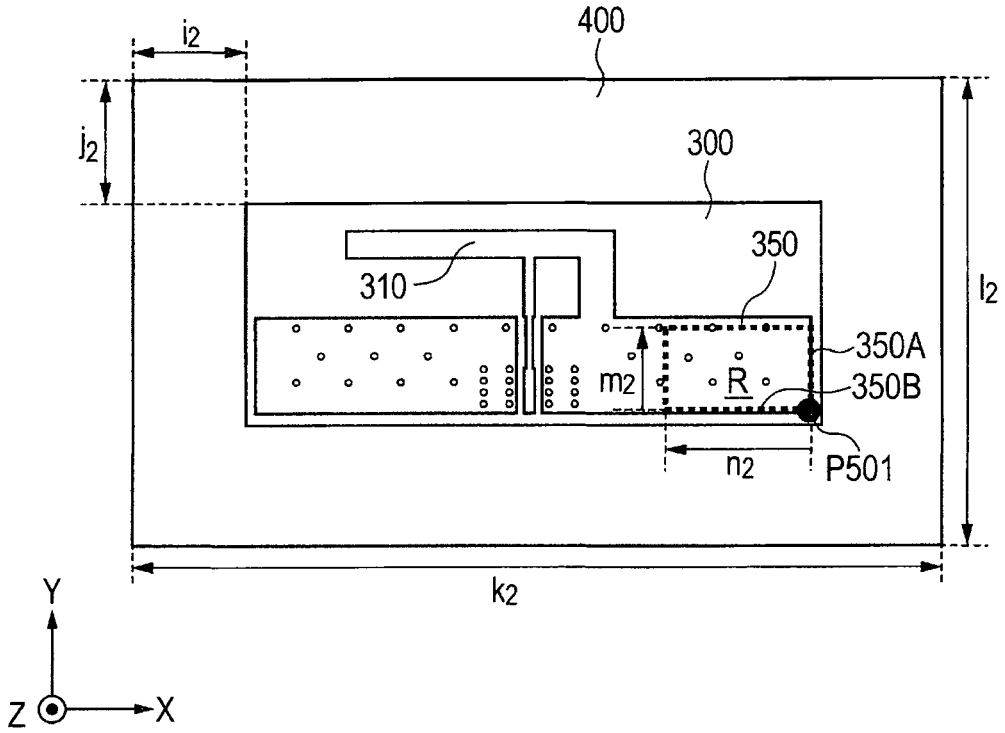
FIG. 21A is a plan view illustrating the dimensions and arrangement positions of the antenna and the metal member of Example 3.
Figure 21B:
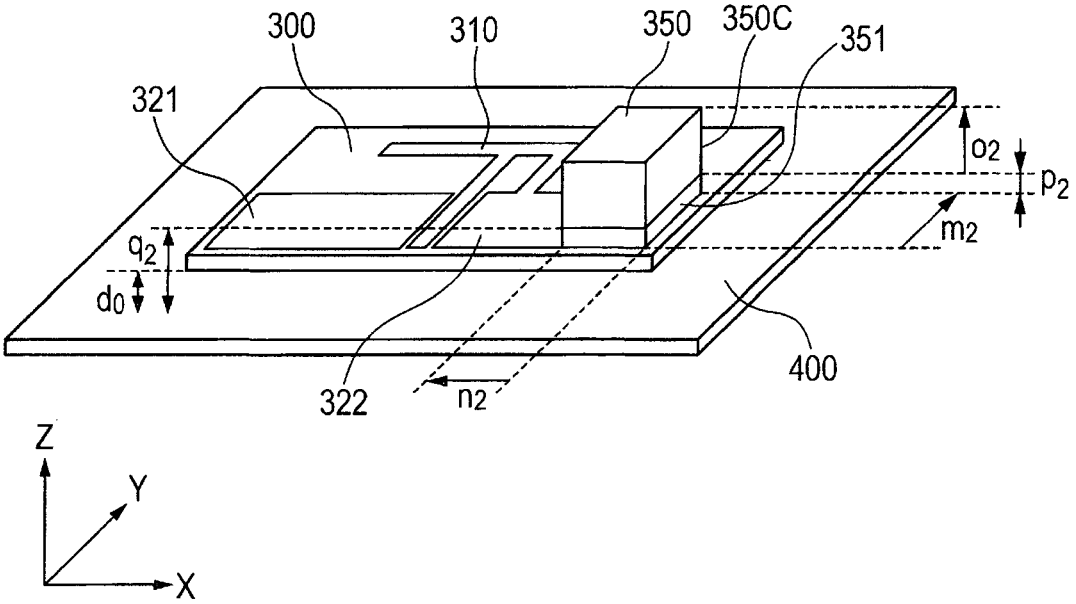
FIG. 21B is a perspective view illustrating the dimensions and arrangement positions of the antenna and the metal member of Example 3.

FIG. 21A is a plan view illustrating the dimensions and arrangement positions of the antenna 300 and the metal member 400. FIG. 21B is a perspective view illustrating the dimensions and arrangement positions of the antenna 300 and the metal member 400. In FIG. 21A, the region R in which the block-shaped conductor piece 350 is arranged is indicated by broken lines. The thickness of the metal member 400 was configured to be 0.5 [mm].

Hereinafter, a result of discussion in the case where the size of the conductor piece 350 is changed. However, the origin is set to a point P501, and the dimensions $n_2$ and $m_2$ were changed. As the fixation of the conductor piece 350, the connection member 351 was made of a dielectric substance with the dimensions $n_2$ and $m_2$, a thickness $p_2$=0.1 [mm], and the relative dielectric constant of 3.5 assuming use of an adhesive.

Table 1 shows the dimensions in FIGS. 20A, 20B, 21A and 21B. The surface 400A of the metal member 400 and the surface 300A of the antenna 300 are arranged so as to be parallel to each other. The distance from the surface 400A of the metal member 400 to the surface 300A of the antenna 300 is defined as $d_0$.

TABLE 1

| Dimensions of Calculation Model [mm] | | | | | | | | | |
|---|---|---|---|---|---|---|---|---|---|
| a | b | c | d | e | f | g | h | i | j |
| 5.3 | 41.775 | 0.85 | 3.0 | 20.025 | 17.975 | 2.5 | 24.425 | 26.475 | 10.2 |
| k | l | m | n | o | p | q | r | s | t |
| 49.975 | 50.9 | 8.5 | 1.0 | 49.05 | 2.4 | 3.25 | 4.7 | 2.35 | 19.8 |
| u | $d_0$ | $i_2$ | $j_2$ | $k_2$ | $l_2$ | $m_2$ | $n_2$ | $o_2$ | $p_2$ |
| 20.1 | Variable | 15.0 | 15.0 | 80.9 | 49.8 | Variable | Variable | Variable | 0.1 |

Table 2 shows the radiation efficiencies in the cases of presence and absence of the conductor piece 350, assuming that the dimensions of the conductor piece 350 are $m_2$=8.5 [mm], $n_2$=7 [mm] and $o_2$=10 [mm], and $d_0$=2 [mm]. Table 2 shows that the radiation efficiency is improved by at least 10 times by providing the conductor piece 350.

TABLE 2

| | Without Conductor Piece 350 | With Conductor Piece 350 |
|---|---|---|
| Radiation Efficiency [%] | 6.5 | 72.7 |

Here, as the conductor piece 350 is a rectangular parallelepiped, the external shape is rectangular as viewed in the −Z direction as illustrated in FIG. 21A. That is, as viewed in the −Z direction, as illustrated in FIG. 21A, the conductor piece 350 is a rectangle having a side (first side) 350A that extends in the Y direction and a side (second side) 350B that extends in the X direction and intersects with the side 350A. The conductor piece 350 is attached to the region R on this rectangular surface. As illustrated in FIG. 21B, the conductor piece 350 has a side (third side) 350C extending in the height direction (Z direction). That is, the conductor piece 350 is a rectangular parallelepiped having the sides 350A, 350B and 350C that are orthogonal to each other. A region on the surface of the ground conductor 320 to which the rectangular portion having the sides 350A and 350B are attached is the region R. The conductor piece 350 is arranged such that the side 350A of the conductor piece 350 is overlaid on the end 320B of the ground conductor 320, and the corner between the side 350A and the side 350B of the conductor piece 350 is overlaid on the corner (point P501) on the side of the end 320B of the ground conductor 320.

Figure 31:
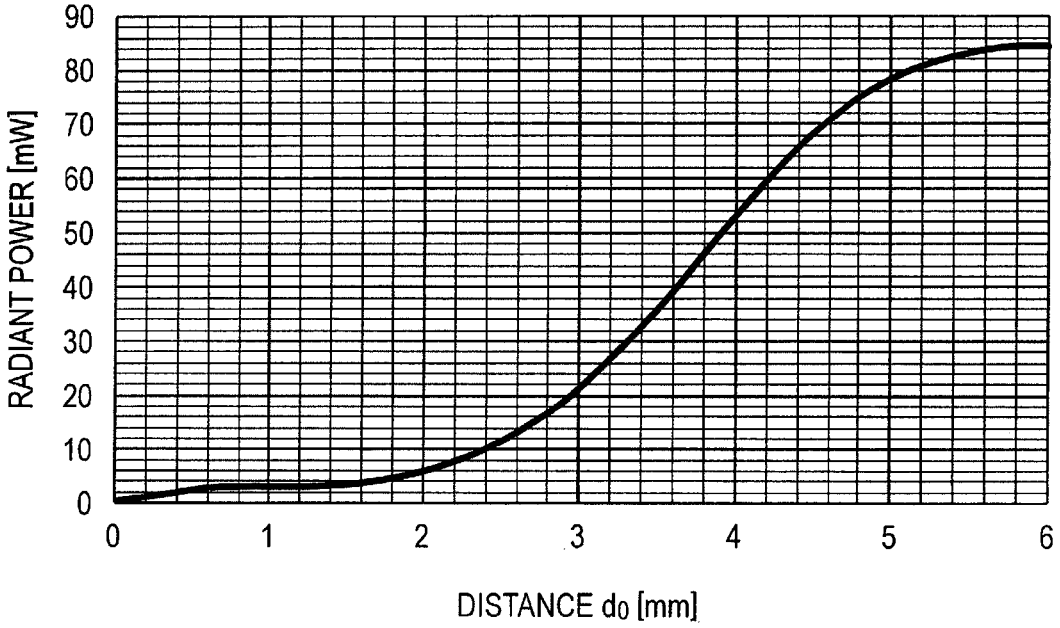
FIG. 31 is a graph illustrating the radiant power with respect to the distance between the antenna and the metal member of the comparative example.

Next, the dimensions of the arrangement position and each variable are defined. FIG. 31 illustrates the transition of the radiant power [mW] in the case of changing the gap $d_0$ [mm] in the state where the power supplied to the antenna 1300 is 100 [mW] and the conductor piece 350 is not provided. That is, FIG. 31 is a graph illustrating the radiant power with respect to the distance between the antenna 1300 and the metal member 400 of the comparative example. FIG. 31 illustrates that as the gap $d_0$ from the metal member 400 to the antenna 1300 is reduced, the radiant power decreases accordingly.

In this Example, the arrangement position of the conductor piece 350 with respect to the ground conductor 320 is illustrated. As described above, the conductor piece 350 is thus arranged to be overlaid on the site on the surface of the ground conductor 320 where the electric field is strong and the magnetic field is weak, i.e., the site with the maximum wave impedance E/H [Ω], thereby improving the radiation efficiency of the antenna 300.

Figure 22A:
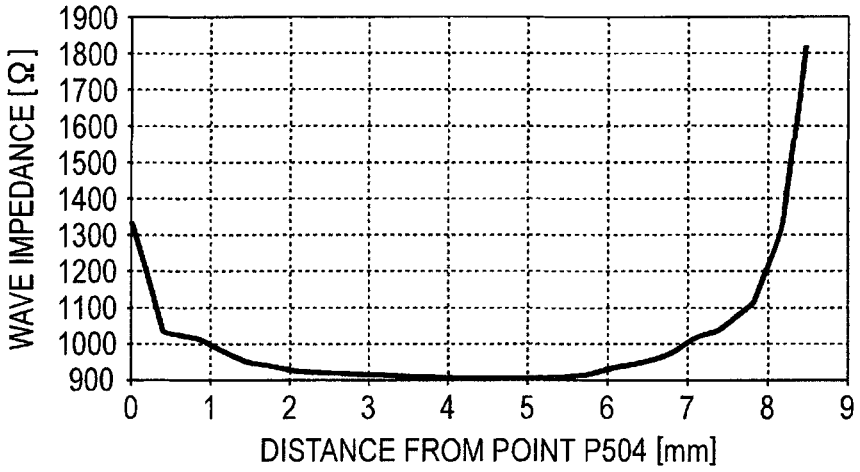
FIG. 22A is a graph illustrating the value of wave impedance at the end of the ground pattern in Example 3.
Figure 22B:
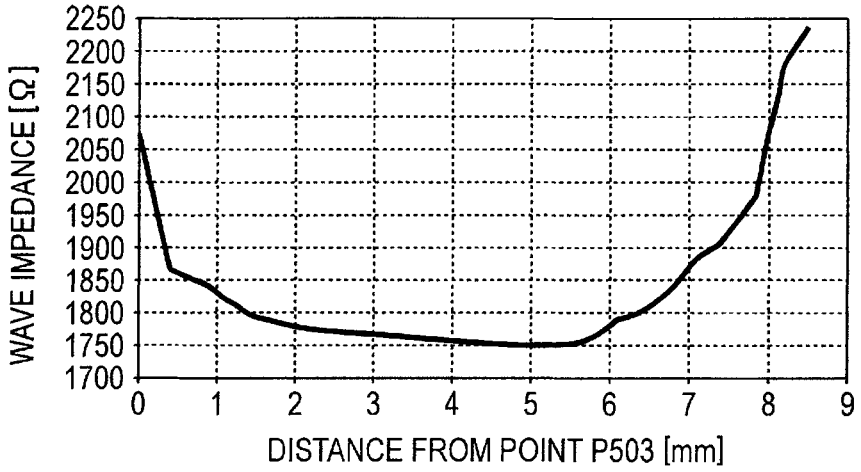
FIG. 22B is a graph illustrating the value of wave impedance at the end of the ground pattern in Example 3.
Figure 22C:
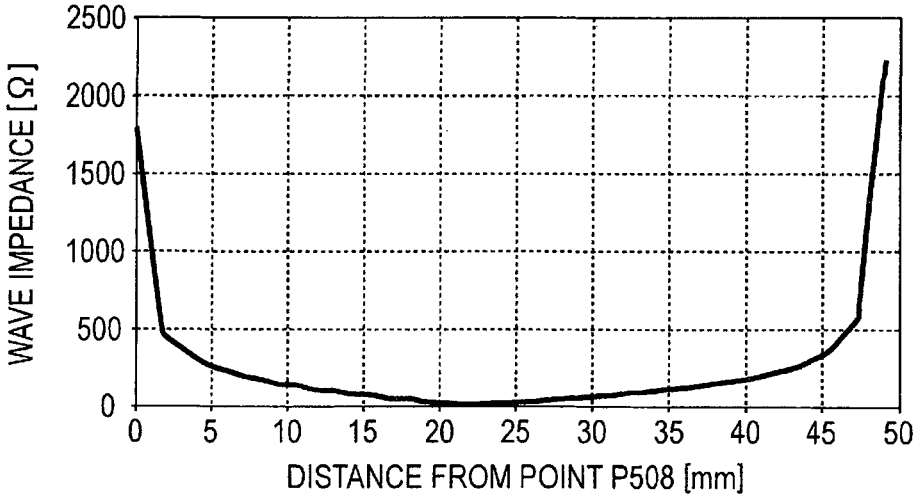
FIG. 22C is a graph illustrating the value of wave impedance at the end of the ground pattern in Example 3.

FIGS. 22A, 22B and 22C illustrate the values of wave impedance [Ω] at the resonant frequency of 2.67 [GHz] of the ground conductor 320 of the antenna 1300 and the metal member 400 in the case of FIG. 21B where the conductor piece 350 and the connection member 351 made of the dielectric substance are not provided. The gap $d_0$ in FIG. 21B was configured to be 2.0 [mm].

FIG. 22A is a graph illustrating the value of wave impedance with respect to the distance in the direction from a point P504 to a point P508 at the end 323A of the ground pattern 323 illustrated in FIG. 20B. FIG. 22A illustrates that, in the case where the distance from the point P504 is 8.5 [mm], i.e., at the point P508, the value of the wave impedance is 1820 [Ω].

FIG. 22B is a graph illustrating the value of wave impedance with respect to the distance in the direction from a point P503 to a point P502 at the end 323B of the ground pattern 323 illustrated in FIG. 20B. FIG. 22B illustrates that, in the case where the distance from the point P503 is 8.5 [mm], i.e., at the point P502, the value of the wave impedance is 2240 [Ω], which is the maximum.

FIG. 22C is a graph illustrating the value of wave impedance with respect to the distance in the direction from the point P508 to the point P502 at the end 323B of the ground pattern 323 illustrated in FIG. 20B. FIG. 22C illustrates that, in the case where the distance from the point P508 is 49.1 [mm], i.e., at the point P502, the value of the wave impedance is 2240 [Ω], which is the maximum.

As described above, the site with the maximum wave impedance among the ends 323A, 323B and 323C of the ground pattern 323 is the point P502. The wave impedances at the point P501 and the point P502 are substantially identical to each other. Consequently, a part of the conductor piece 350 may be arranged to be close to the point P501 or the point P502.

Next, the communication characteristics in the case where the dimensions are fixed such that $n_2$=[mm], $o_2$=9 [mm], and $d_0$=2 [mm] while $m_2$ is changed are evaluated. Here, the dimension $m_2$ is the length of the side 350A of the conductor piece 350. Here, the dimension $n_2$ is the length of the side 350B of the conductor piece 350. The dimension $o_2$ is the length of the conductor piece 350 in the Z direction, i.e., the length of the side 350C of the conductor piece 350. The gap in the Z direction between the metal member 400 and the conductor piece 350 is defined as $q_2$.

Figure 23A:
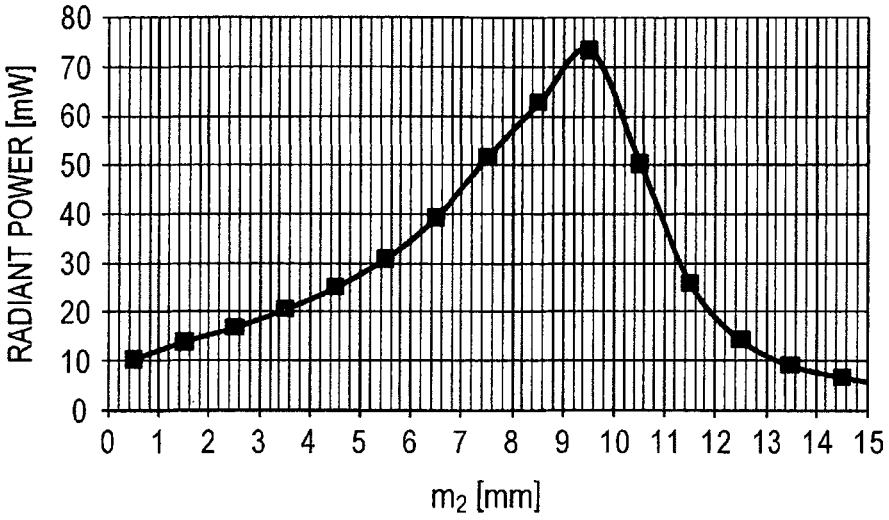
FIG. 23A is a graph illustrating the radiant power of the conductor piece with respect to the length of the side in Example 3.

FIG. 23A is a graph illustrating the radiant power in the case where the value of $m_2$ is changed from 0.5 [mm] to 15 [mm] along a short-side direction (Y direction) of the ground pattern 322 from the point P501 illustrated in FIG. 21A. That is, FIG. 23A is a graph illustrating the radiant power of the conductor piece 350 with respect to the length of the side 350A in Example 3.

As illustrated in FIG. 23A, the dimension $m_2$ where the radiant power is twice or more higher than the radiant power of 6.5 [mW] in the case without the conductor piece 350 is 1.5 [mm] or more and 12.5 [mm] or less. Furthermore, the dimension $m_2$ where the radiant power is five or more times higher than that in the case without the conductor piece 350 can be 5.8 [mm] or more and 11.2 [mm] or less. In the case of the dimension $m_2$ of 9.5 [mm], the maximum effect can be obtained.

As illustrated in FIG. 20A, the length of the end 320B of the ground conductor 320 (the end 322B of the ground pattern 322) in the Y direction is defined as m. The dimension $m_2$ of the conductor piece 350 is normalized as a ratio thereof to m. The range of the dimension $m_2$ where the value is twice or more higher than the case without the conductor piece 350 is $0.176 \leq m_2/m \leq 1.471$. That is, the length of the side 350A where the radiant power is twice or more higher is a length that is 0.176 or more times and 1.471 or less times as long as the length in the Y direction on the end 320B of the ground conductor 320.

Figure 23B:
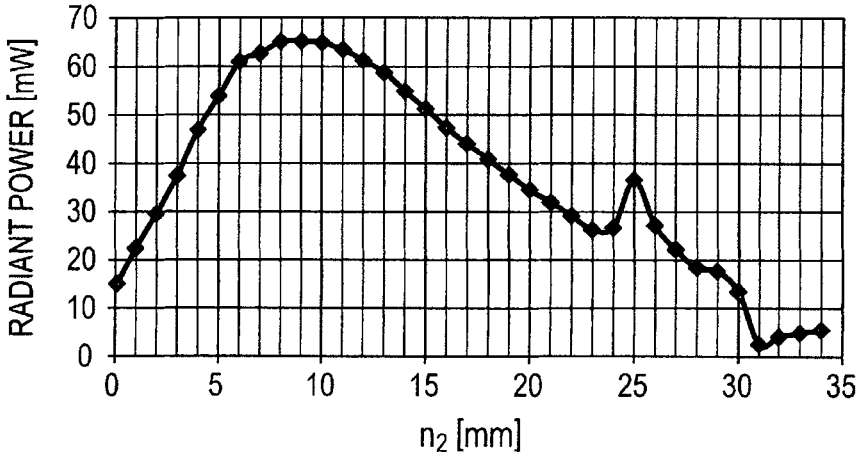
FIG. 23B is a graph illustrating the radiant power of the conductor piece with respect to the length of the side in Example 3.

Next, the communication characteristics in the case where the dimensions are fixed such that $m_2$=8.5 [mm], $o_2$=9 [mm], and $d_0$=2 [mm] while $n_2$ is changed are evaluated. FIG. 23B illustrates the radiant power in the case where the dimension $n_2$ is changed from 0.1 [mm] to 35 [mm] along a longitudinal direction (X direction) of the ground pattern from the point P501 illustrated in FIG. 21A. That is, FIG. 23B is a graph illustrating the radiant power of the conductor piece 350 with respect to the length of the side 350B in Example 3.

As illustrated in FIG. 23B, the dimension $n_2$ where the value is twice or higher than that in the case without the conductor piece 350 is 0.1 [mm] or more and 30 [mm] or less. Furthermore, the dimension $n_2$ where the value is five or more times higher than that in the case without the conductor piece 350 is 3 [mm] or more and 20 [mm] or less. In the case of the dimension $n_2$ of 9 [mm], the maximum effect can be obtained.

As illustrated in FIG. 20A, at the connection portion 320C where the end 320B of the ground conductor 320 is connected with the other end 310B of the antenna element 310, the length (gap) from a connection point P511 on the side close to the end 320A is defined as u. The dimension $n_2$ of the side 350B of the conductor piece 350 is normalized as a ratio thereof to the dimension u. The range of the dimension $n_2$ where the radiant power is twice or more higher than the case without the conductor piece 350 is $0.005 \leq n_2/u \leq 1.493$. That is, the length $n_2$ of the side 350B of the conductor piece 350 where the radiant power is twice or more higher is that 0.005 times or more and 1.493 or less times as large as the dimension u.

Figure 23C:
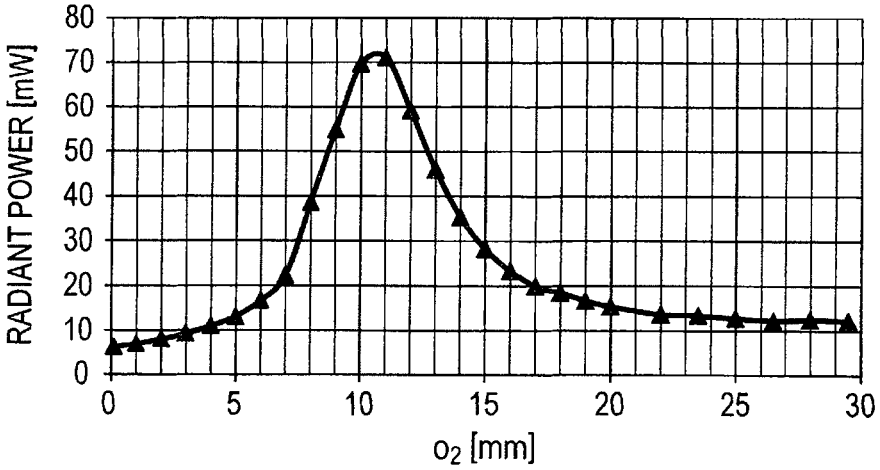
FIG. 23C is a graph illustrating the radiant power of the conductor piece with respect to the length of the side in Example 3.

Next, the communication characteristics in the case where the dimensions are fixed such that $m_2$=8.5 [mm], $n_2$=14 [mm], and $d_0$=2 [mm] while $o_2$ is changed are evaluated. FIG. 23C illustrates the radiant power in the case where the dimension $o_2$ is changed from 0.1 [mm] to 30 [mm]. That is, FIG. 23C is a graph illustrating the radiant power of the conductor piece 350 with respect to the length of the side 350C in Example 3. The dimension $o_2$ where the value is twice or more higher than that in the case without the conductor piece 350 is 5 [mm] or more and 13 [mm] or less. Furthermore, the dimension $o_2$ where the value is five or more times higher than that in the case without the conductor piece 350 can be 8 [mm] or more and 14 [mm] or less. In the case of the dimension $o_2$ of 10.5 [mm], the maximum effect can be obtained.

As illustrated in FIG. 18, the capacitive coupling of capacitances $C_1$, $C_2$, $C_3$ and $C_4$ is formed between the conductor piece 350 and the metal member 400. Thus, $q_2$=3.515 [mm] that is the value of sum of the distance $d_0$ from the metal member 400 to the antenna 300, the thickness $p_2$ of the connection member 351 made of a dielectric substance, and the thickness 1.415 [mm] of the antenna 300 is used to normalize the dimension $o_2$ of the conductor piece 350 as the ratio thereof to $q_2$. The range of the $o_2$ where the radiant power is twice or more higher than the case without the conductor piece 350 is $2.276 \leq o_2/q_2 \leq 3.983$. That is, the length $o_2$ of the side 350C of the conductor piece 350 where the radiant power is twice or more higher is that 2.276 times or more and 3.983 or less times as long as the dimension $q_2$.

The present invention is not limited by the embodiment described above. Instead, various modifications can be made within the technical thought of the present invention. The advantageous effects described in the embodiments of the present invention can be only a list of advantageous effects exerted by the present invention. The advantageous effects by the present invention are not limited by the description in the embodiments of the present invention.

Figure 24A:
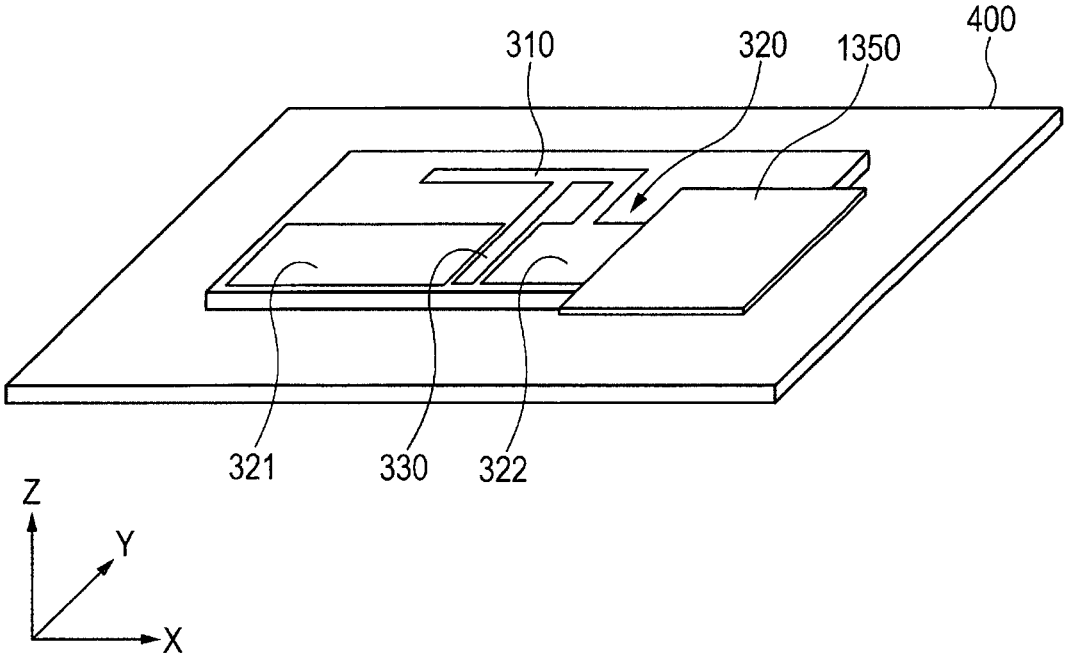
FIG. 24A is a diagram illustrating an example variation (I) of the conductor piece.

In the third embodiment, the surface where the capacitances $C_1$, $C_2$ and $C_3$ are formed is arranged in the Z direction, i.e., in the direction perpendicular to the surface of the ground pattern of the antenna 300. However, the configuration is not limited thereto. FIG. 24A is a diagram illustrating an example variation. As illustrated in FIG. 24A, a conductor piece 1350 may be a conductive plate provided in the direction horizontal to the surface of the ground pattern 322.

Figure 24B:
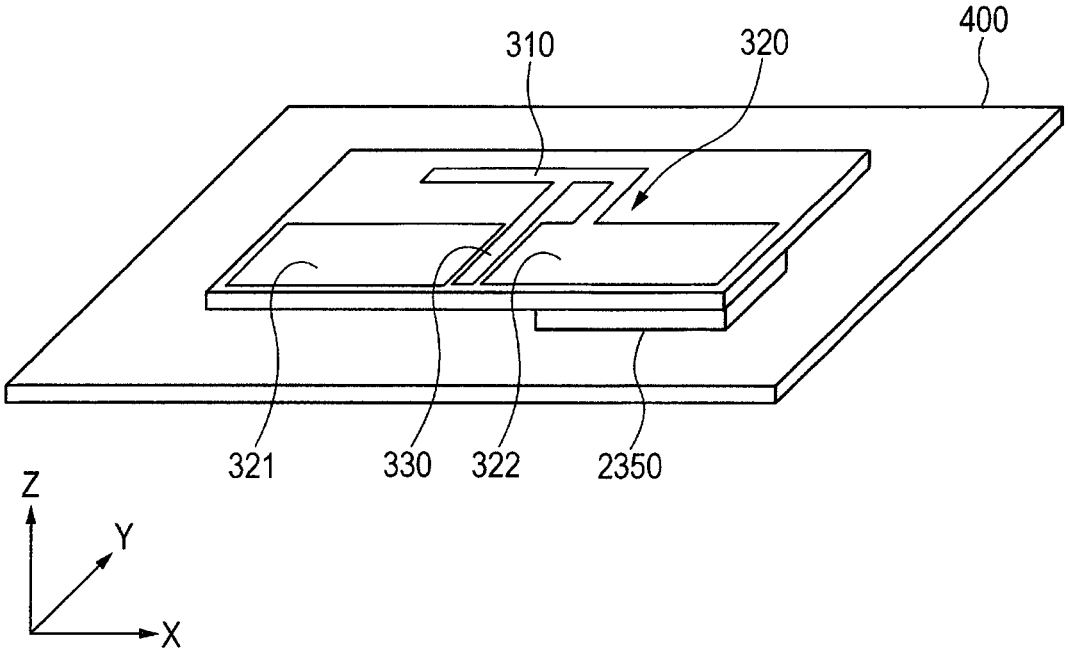
FIG. 24B is a diagram illustrating an example variation (II) of the conductor piece.

In the third embodiment, the description has been made for the case where the conductor piece 350 is arranged on the side opposite to the side of the metal member 400 with respect to the ground conductor 320, i.e., the case of formation projecting on the side opposite to the side toward the metal member 400. However, the configuration is not limited thereto. FIG. 24B is a diagram illustrating an example variation of the conductor piece. As illustrated in FIG. 24B, it may be configured such that a conductor piece 2350 is arranged on the side of the metal member 400 with respect to the ground conductor 320, i.e., this piece is formed to project to the side toward the metal member 400.

In the third embodiment, the conductor piece 350 is caused to adhere and be fixed using an adhesive (connection member) made of a dielectric substance. Alternatively, this piece may be fixed to the ground conductor 320 using a connection member made of metal (conductor), e.g., solder. The conductor piece may be formed integrally with the ground conductor.

In the third embodiment, as illustrated in FIG. 17B, the description has been made for the case where the resonant frequency $f_2$ of the antenna and the metal member is a frequency higher than the communication frequency $f_0$. On the contrary, in the case of occurrence at a low frequency, the conductor piece 350 may be arranged at a site with a low wave impedance, i.e., around the center in the longitudinal direction of the ground pattern illustrated in FIG. 22C.

In the third embodiment, the description has been made for the case where the shape of the conductor piece 350 is a rectangular parallelepiped. This shape may be circular or polygonal columnar. Alternatively, a step or a curved surface may be provided.

In the third embodiment, the description has been made for the case where the inside of the conductor piece 350 is filled with metal. Alternatively, as long as the capacitances $C_1$, $C_2$ and $C_3$ are formed on the side illustrated in FIG. 18, the inside of the conductor piece may be hollow. A shape of vessel without one surface may be used or one or more sides may be omitted. That is, as long as the surface area is larger than the area of the region R, the external shape of the conductor piece may be any shape.

In the third embodiment, the description has been made for the case of application where the antenna 300 is the inverted-F antenna. Alternatively, as long as the antenna is a patterned antenna having a ground pattern arranged on the same plane as or a plane parallel to that of the antenna element, the present invention is applicable.

In the third embodiment, the description has been made for the case where the electronic apparatus is an X-ray image diagnostic apparatus, which is an example of an imaging apparatus. However, the configuration is not limited thereto. For example, the imaging apparatus may be any of a digital camera and a smartphone. The present invention is applicable to any electronic apparatus other than the imaging apparatus.

According to the third embodiment of the present invention, the resonant frequency of the antenna and the metal member is shifted to the side of the communication frequency, which can improve the communication characteristics at the communication frequency of the radio element while reducing the power consumption of the radio element.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-029369, filed Feb. 18, 2015, Japanese Patent Application No. 2015-029371, filed Feb. 18, 2015, and Japanese Patent Application No. 2015-029370, filed Feb. 18, 2015 which are hereby incorporated by reference herein in their entirety.

REFERENCE SIGNS LIST

105 IC (radio element)
200 X-ray image diagnostic apparatus (electronic apparatus)
202 Wireless communication device
300 Antenna
310 Antenna element
320 Ground conductor
330 Signal line
350 Conductor piece
400 Metal member
401 Metal plate
402 Projection
412 Concave

The invention claimed is:

1. A wireless communication device comprising:
an antenna;
a radio element connected to the antenna; and
a metal member separated from the antenna,
wherein the antenna includes:
an antenna element including an open end, the antenna element being formed on a conductive layer, the conductive layer extending more in first (X) and second (Y) directions orthogonal to each other than in a third direction orthogonal to the first and second directions; and
a ground conductor connected to the antenna element, the ground conductor being used as a ground,
wherein the metal member is arranged to face the antenna in the third direction,
wherein the metal member includes:
a first portion facing the ground conductor in the third direction; and
a second portion facing the ground conductor in the third direction, and
wherein a first distance between the first portion and the ground conductor is smaller than a second distance between the second portion and the ground conductor.

2. An electronic apparatus comprising:
an imaging element configured to take an image signal; and
the wireless communication device according to claim 1 configured to obtain the image signal to transmit the image signal to another wireless communication device.

3. The wireless communication device according to claim 1, wherein the antenna is an inverted-F antenna, and the conductive layer is a part of a printed wiring board.

4. The wireless communication device according to claim 1, wherein the first distance is in a range 0.34 or more times and 0.63 or less times as large as the second distance.

5. The wireless communication device according to claim 1, wherein the metal member includes a third portion, the third portion faces the antenna element in the third direction.

6. The wireless communication device according to claim 5, wherein a third distance between the third portion and the antenna element is larger than the second distance.

7. The wireless communication device according to claim 1, wherein the metal member includes a fourth portion, the fourth portion faces the open end in the third direction, a fourth distance between the fourth portion and the open end is larger than the first distance.

8. The wireless communication device according to claim 1, wherein the antenna includes a signal line through which the radio element is connected to the antenna element, wherein the metal member includes a fifth portion, the fifth portion faces the signal line in the third direction, a fifth distance between the fifth portion and the signal line is larger than the first distance.

9. The wireless communication device according to claim 1, wherein the antenna includes a signal line through which the radio element is connected to the antenna element, the ground conductor includes a first ground pattern and a second ground pattern, and the signal line is arranged between the first ground pattern and the second ground pattern in the first direction.

10. The wireless communication device according to claim 9, wherein the ground conductor includes a third ground pattern, and an insulation layer is arranged between the third ground pattern and the signal line in the third direction.

11. A wireless communication device comprising:

an antenna that includes:

an antenna element including one end that is open; and a ground conductor to which another end of the antenna element is connected and which is used as a ground;

a metal member arranged to face the antenna and physically separated from the antenna; and a radio element connected to the antenna, wherein the metal member includes:

a metal main body; and a projection that projects from the metal main body toward the antenna, the projection facing the ground conductor, wherein the ground conductor includes a first end located on a side of the open one end of the antenna element, and a second end located on a side opposite to the open one end of the antenna element, and wherein the projection is provided in at least one region between a first region facing a first end of the metal member and a second region facing the second end of the ground conductor.

12. The wireless communication device according to claim 11, wherein a signal line is connected to a portion between the one open end and the other end of the antenna element, wherein the antenna element is formed to be bent to have an L-shape along the metal member, and wherein the projection is arranged at a position that does not overlap with the signal line when the metal member is viewed from a side of the antenna.

13. The wireless communication device according to claim 12, wherein the projection is arranged at a position of overlapping with the second end of the ground conductor as viewed in the facing direction, and, when the metal member is viewed from the side of the antenna, an overlapping portion of the projection and the ground conductor has an area in a range 0.33 or more times and 1.0 or less times as large as an area of a rectangular region where a connection portion between the other end of the antenna element and the ground conductor, and a corner on the second end of the ground conductor farthest from the antenna element are included as diagonal apexes.

14. The wireless communication device according to claim 11, wherein, when the metal member is viewed from a side of the antenna, at least a part of the at least one region where the projection is formed overlaps with a third region where a ratio of an electric field intensity to a magnetic field intensity of the antenna is 0.55 or more times and 1.0 or less times as high as a maximum value.

15. The wireless communication device according to claim 14, wherein a signal line is connected to a portion between the one open end and the other end of the antenna element, wherein the antenna element is formed to be bent to have an L-shape along the metal member, and wherein the projection is arranged at a position that does not overlap with the signal line when the metal member is viewed from a side of the antenna.

16. The wireless communication device according to claim 15, wherein a capacitance between the projection and the ground conductor is in a range 1.6 or more times and 2.9 or less times as high as a capacitance between the metal main body and the ground conductor.

17. The wireless communication device according to claim 15, wherein, when the metal member is viewed from the side of the antenna, an overlapping portion of the projection and the ground conductor has an area in a range 0.33 or more times and 1.0 or less times as large as an area of a rectangular region where a connection portion between the other end of the antenna element and the ground conductor, and a corner on the second end of the ground conductor farthest from the antenna element are included as diagonal apexes.

18. The wireless communication device according to claim 17, wherein, when the metal member is viewed from a side of the antenna, the overlapping portion has an area in a range 0.55 or more times and 0.81 or less times as large as an area of the rectangular region, and a gap between the projection and the ground conductor in the facing direction is in a range 0.34 or more times and 0.63 or less times as large as a gap between the metal main body and the ground conductor in the facing direction.

19. The wireless communication device according to claim 11, wherein an inductance L between the metal member and the ground conductor×capacitance C in the projection has a value higher than a value in a region other than the at least one of the first region and the second region.

20. An electronic apparatus comprising:

an imaging element configured to take an image signal; and the wireless communication device according to claim 11 configured to obtain the image signal to transmit the image signal to another wireless communication device.

* * * * *